US007354342B2

(12) United States Patent
Paulsen et al.

(10) Patent No.: US 7,354,342 B2
(45) Date of Patent: Apr. 8, 2008

(54) GAMING DEVICE HAVING A MULTIPLE COORDINATE AWARD DISTRIBUTOR INCLUDING AWARD PERCENTAGES

(75) Inventors: Craig A. Paulsen, Reno, NV (US); Binh T. Nguyen, Reno, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 768 days.

(21) Appl. No.: 10/769,086

(22) Filed: Jan. 29, 2004

(65) Prior Publication Data

US 2005/0026673 A1 Feb. 3, 2005

Related U.S. Application Data

(63) Continuation-in-part of application No. 10/630,529, filed on Jul. 30, 2003.

(51) Int. Cl.
*A63F 9/24* (2006.01)

(52) U.S. Cl. ..... 463/16; 463/17; 463/18; 273/142 R

(58) Field of Classification Search ..... 463/16–19, 463/30, 31

See application file for complete search history.

(56) References Cited

U.S. PATENT DOCUMENTS

| | | | |
|---|---|---|---|
| 1,527,929 | A | 2/1925 | Simons |
| 3,642,287 | A | 2/1972 | Lally et al. |
| 4,198,052 | A | 4/1980 | Gauselmann |
| 4,448,419 | A | 5/1984 | Telnaes |
| 4,508,357 | A | 4/1985 | Reich |
| 4,560,161 | A | 12/1985 | Hamano |
| 4,582,324 | A | 4/1986 | Koza et al. |
| 4,624,459 | A | 11/1986 | Kaufman |

(Continued)

FOREIGN PATENT DOCUMENTS

| | | | |
|---|---|---|---|
| AU | 199717601 | B2 | 9/1997 |

(Continued)

OTHER PUBLICATIONS

American Bandstand Game advertisement written by IGT, published in 2001.

(Continued)

*Primary Examiner*—Corbett B. Coburn
*Assistant Examiner*—David W Duffy
(74) *Attorney, Agent, or Firm*—Bell Boyd & Lloyd LLP

(57) ABSTRACT

A gaming device includes an award distributor having a plurality of sections having first and second coordinates, a symbol group and a plurality of modifier groups including the sections, a plurality of awards associated with the sections in the symbol group and a plurality of award percentages associated with the sections in the modifier groups, an illumination device associated with the sections, a section indicator associated with the award distributor and a processor in communication with the award distributor. The gaming device determines the first coordinate of one of the modifier groups and then spins the award wheel to determine the second coordinate of one of the sections in the indicated modifier group, which indicates the section. The section indicator also indicates a section including an award in the symbol group. The indicated award is multiplied by the indicated award percentage to provide an activation award to the player.

71 Claims, 31 Drawing Sheets

U.S. PATENT DOCUMENTS

| | | | |
|---|---|---|---|
| 4,695,053 | A | 9/1987 | Vazquez, Jr. et al. |
| 4,775,155 | A | 10/1988 | Lees |
| 4,838,552 | A | 6/1989 | Hagiwara |
| 4,991,848 | A | 2/1991 | Greenwood et al. |
| 5,085,436 | A | 2/1992 | Bennett |
| 5,102,134 | A | 4/1992 | Smyth |
| 5,178,390 | A | 1/1993 | Okada |
| 5,205,555 | A | 4/1993 | Hamano |
| 5,308,065 | A | 5/1994 | Bridgeman et al. |
| 5,324,041 | A | 6/1994 | Boylan et al. |
| 5,332,228 | A | 7/1994 | Schultz |
| 5,342,047 | A | 8/1994 | Heidel et al. |
| 5,393,061 | A | 2/1995 | Manship et al. |
| 5,423,539 | A | 6/1995 | Nagao |
| 5,431,408 | A | 7/1995 | Adams |
| 5,449,173 | A | 9/1995 | Thomas et al. |
| 5,456,465 | A | 10/1995 | Durham |
| 5,524,888 | A | 6/1996 | Heidel |
| 5,536,016 | A | 7/1996 | Thompson |
| 5,542,669 | A | 8/1996 | Charron et al. |
| 5,560,603 | A | 10/1996 | Seelig et al. |
| 5,569,084 | A | 10/1996 | Nicastro et al. |
| 5,584,764 | A | 12/1996 | Inoue |
| 5,609,524 | A | 3/1997 | Inoue |
| 5,611,535 | A | 3/1997 | Tiberio |
| 5,711,525 | A | 1/1998 | Breeding |
| 5,722,891 | A | 3/1998 | Inoue |
| 5,769,716 | A | 6/1998 | Saffari et al. |
| 5,772,509 | A | 6/1998 | Weiss |
| 5,775,692 | A | 7/1998 | Watts et al. |
| 5,788,573 | A | 8/1998 | Baerlocher et al. |
| 5,810,361 | A | 9/1998 | Kadlic |
| 5,823,873 | A | 10/1998 | Moody |
| 5,823,874 | A | 10/1998 | Adams |
| 5,833,537 | A | 11/1998 | Barrie |
| 5,833,538 | A | 11/1998 | Weiss |
| 5,848,932 | A | 12/1998 | Adams |
| 5,851,148 | A | 12/1998 | Brune et al. |
| 5,873,781 | A | 2/1999 | Keane |
| 5,882,261 | A | 3/1999 | Adams |
| 5,902,184 | A | 5/1999 | Bennett et al. |
| 5,911,418 | A | 6/1999 | Adams |
| 5,919,091 | A | 7/1999 | Bell et al. |
| 5,927,714 | A | 7/1999 | Kaplan |
| 5,935,002 | A | 8/1999 | Falciglia |
| 5,947,820 | A | 9/1999 | Morro et al. |
| 5,951,397 | A | 9/1999 | Dickinson |
| 5,964,463 | A | 10/1999 | Moore, Jr. |
| 5,967,894 | A | 10/1999 | Kinoshita et al. |
| 5,980,384 | A | 11/1999 | Barrie |
| 5,984,781 | A | 11/1999 | Sunaga |
| 5,988,643 | A | 11/1999 | Awada |
| 5,989,121 | A | 11/1999 | Sakamoto |
| 5,996,997 | A | 12/1999 | Kamille |
| 5,997,400 | A | 12/1999 | Seelig et al. |
| 5,997,401 | A | 12/1999 | Crawford |
| 6,004,207 | A | 12/1999 | Wilson, Jr. et al. |
| 6,015,346 | A | 1/2000 | Bennett |
| 6,019,369 | A | 2/2000 | Nakagawa et al. |
| 6,033,307 | A | 3/2000 | Vancura |
| 6,056,642 | A | 5/2000 | Bennett |
| 6,059,289 | A | 5/2000 | Vancura |
| 6,059,658 | A | 5/2000 | Mangano et al. |
| 6,062,980 | A | 5/2000 | Luciano |
| 6,089,976 | A | 7/2000 | Schneider et al. |
| 6,089,977 | A | 7/2000 | Bennett |
| 6,089,978 | A | 7/2000 | Adams |
| 6,093,102 | A | 7/2000 | Bennett |
| 6,102,798 | A | 8/2000 | Bennett |
| 6,105,962 | A | 8/2000 | Malavazos et al. |
| 6,120,031 | A | 9/2000 | Adams |
| 6,126,541 | A | 10/2000 | Fuchs |
| 6,126,542 | A | 10/2000 | Fier |
| 6,129,355 | A | 10/2000 | Hahn et al. |
| 6,142,873 | A | 11/2000 | Weiss et al. |
| 6,142,874 | A | 11/2000 | Kodachi et al. |
| 6,142,875 | A | 11/2000 | Kodachi et al. |
| 6,146,271 | A | 11/2000 | Kadlic |
| 6,146,273 | A | 11/2000 | Olsen |
| 6,149,156 | A | 11/2000 | Feola |
| 6,149,157 | A | 11/2000 | Suan |
| 6,155,925 | A | 12/2000 | Giobbi et al. |
| 6,159,095 | A | 12/2000 | Frohm et al. |
| 6,159,096 | A | 12/2000 | Yoseloff |
| 6,159,097 | A | 12/2000 | Gura |
| 6,159,098 | A | 12/2000 | Slomiany et al. |
| 6,162,121 | A | 12/2000 | Morro et al. |
| 6,164,652 | A | 12/2000 | Lauretta et al. |
| 6,168,520 | B1 | 1/2001 | Baerlocher et al. |
| 6,168,523 | B1 | 1/2001 | Piechowiak et al. |
| 6,173,955 | B1 | 1/2001 | Perrie et al. |
| 6,174,233 | B1 | 1/2001 | Sunaga et al. |
| 6,174,235 | B1 | 1/2001 | Walker et al. |
| 6,186,894 | B1 | 2/2001 | Mayeroff |
| 6,190,254 | B1 | 2/2001 | Bennett |
| 6,190,255 | B1 | 2/2001 | Thomas et al. |
| 6,203,429 | B1 | 3/2001 | Demar et al. |
| 6,210,279 | B1 | 4/2001 | Dickinson |
| 6,213,876 | B1 | 4/2001 | Moore, Jr. |
| 6,220,959 | B1 | 4/2001 | Holmes, Jr. et al. |
| 6,224,483 | B1 | 5/2001 | Mayeroff |
| 6,227,969 | B1 | 5/2001 | Yoseloff |
| 6,227,971 | B1 | 5/2001 | Weiss |
| 6,231,442 | B1 | 5/2001 | Mayeroff |
| 6,231,445 | B1 | 5/2001 | Acres |
| 6,234,897 | B1 | 5/2001 | Frohm et al. |
| 6,251,013 | B1 | 6/2001 | Bennett |
| 6,261,177 | B1 | 7/2001 | Bennett |
| 6,270,409 | B1 | 8/2001 | Shuster |
| 6,299,165 | B1 | 10/2001 | Nagano |
| 6,299,170 | B1 | 10/2001 | Yoseloff |
| 6,302,398 | B1 | 10/2001 | Vecchio |
| 6,302,790 | B1 | 10/2001 | Brossard |
| 6,305,686 | B1 | 10/2001 | Perrie et al. |
| 6,309,299 | B1 | 10/2001 | Weiss |
| 6,309,300 | B1 | 10/2001 | Glavich |
| 6,311,976 | B1 | 11/2001 | Yoseloff et al. |
| 6,312,334 | B1 | 11/2001 | Yoseloff |
| 6,315,663 | B1 | 11/2001 | Sakamoto |
| 6,315,664 | B1 | 11/2001 | Baerlocher et al. |
| 6,319,124 | B1 | 11/2001 | Baerlocher et al. |
| 6,322,078 | B1 | 11/2001 | Adams |
| 6,328,649 | B1 | 12/2001 | Randall et al. |
| 6,336,860 | B1 | 1/2002 | Webb |
| 6,346,043 | B1 | 2/2002 | Colin et al. |
| 6,347,996 | B1 | 2/2002 | Gilmore et al. |
| 6,358,144 | B1 | 3/2002 | Kaddlic et al. |
| 6,364,766 | B1 | 4/2002 | Anderson et al. |
| 6,364,767 | B1 | 4/2002 | Brossard et al. |
| 6,375,187 | B1 | 4/2002 | Baerlocher |
| 6,375,570 | B1 | 4/2002 | Poole |
| 6,394,902 | B1 | 5/2002 | Glavich et al. |
| 6,398,218 | B1 | 6/2002 | Vancura |
| 6,398,220 | B1 * | 6/2002 | Inoue ..... 273/142 R |
| 6,398,644 | B1 | 6/2002 | Perrie et al. |
| 6,406,369 | B1 | 6/2002 | Baerlocher et al. |
| 6,413,160 | B1 | 7/2002 | Vancura |
| 6,413,161 | B1 | 7/2002 | Baerlocher et al. |
| 6,413,162 | B1 | 7/2002 | Baerlocher et al. |
| 6,419,579 | B1 | 7/2002 | Bennett |
| 6,435,511 | B1 | 8/2002 | Vancura et al. |
| 6,439,943 | B1 | 8/2002 | Aoki et al. |
| 6,439,993 | B1 | 8/2002 | O'Halloran |
| 6,439,995 | B1 | 8/2002 | Hughs-Baird et al. |

| | | | |
|---|---|---|---|
| 6,443,452 | B1 | 9/2002 | Brune |
| 6,443,837 | B1 | 9/2002 | Jaffe et al. |
| 6,454,266 | B1 | 9/2002 | Breeding et al. |
| 6,461,241 | B1 | 10/2002 | Webb et al. |
| 6,464,582 | B1 | 10/2002 | Baerlocher et al. |
| 6,491,584 | B2 | 12/2002 | Graham et al. |
| 6,494,454 | B2 | 12/2002 | Adams |
| 6,494,785 | B1 | 12/2002 | Gerrard et al. |
| 6,506,117 | B2 | 1/2003 | DeMar et al. |
| 6,506,118 | B1 | 1/2003 | Baerlocher et al. |
| 6,514,141 | B1 | 2/2003 | Kaminkow et al. |
| 6,561,512 | B2 | 5/2003 | Luciano et al. |
| 6,561,899 | B2 | 5/2003 | Vancura |
| 6,569,015 | B1 | 5/2003 | Baerlocher et al. |
| 6,575,830 | B2 | 6/2003 | Baerlocher et al. |
| 6,585,591 | B1 | 7/2003 | Baerlocher et al. |
| 6,595,854 | B2 | 7/2003 | Hughs-Baird et al. |
| 6,599,192 | B1 | 7/2003 | Baerlocher et al. |
| 6,604,740 | B1 | 8/2003 | Singer et al. |
| 6,605,000 | B2 | 8/2003 | Adams |
| 6,616,142 | B2 | 9/2003 | Adams |
| 6,620,045 | B2 | 9/2003 | Berman et al. |
| 6,626,758 | B1 | 9/2003 | Parham et al. |
| 6,632,139 | B1 | 10/2003 | Baerlocher |
| 6,632,141 | B2 | 10/2003 | Webb et al. |
| 6,648,754 | B2 | 11/2003 | Baerlocher et al. |
| 6,659,864 | B2 | 12/2003 | McGahn et al. |
| 6,663,488 | B1 | 12/2003 | Adams |
| 6,692,355 | B2 | 2/2004 | Baerlocher et al. |
| 6,705,944 | B2 | 3/2004 | Luciano |
| 6,722,981 | B2 | 4/2004 | Kaminkow et al. |
| 2002/0045475 | A1 | 4/2002 | Glavich et al. |
| 2002/0072402 | A1 | 6/2002 | Baerlocher |
| 2002/0137559 | A1 | 9/2002 | Baerlocher |
| 2002/0142822 | A1 | 10/2002 | Baerlocher et al. |
| 2002/0151350 | A1 | 10/2002 | Baerlocher et al. |
| 2002/0155883 | A1 | 10/2002 | Baerlocher |
| 2002/0187827 | A1 | 12/2002 | Blankstein |
| 2003/0013514 | A1 | 1/2003 | Cregan et al. |
| 2003/0027628 | A1 | 2/2003 | Luciano |
| 2003/0036420 | A1 | 2/2003 | Baerlocher et al. |
| 2003/0040355 | A1 | 2/2003 | Baerlocher |
| 2003/0040360 | A1 | 2/2003 | Kaminkow |
| 2003/0045338 | A1 | 3/2003 | Dolloff et al. |
| 2003/0045344 | A1 | 3/2003 | Webb et al. |
| 2003/0045348 | A1 | 3/2003 | Palmer et al. |
| 2003/0045350 | A1 | 3/2003 | Baerlocher et al. |
| 2003/0060260 | A1 | 3/2003 | Gerrard et al. |
| 2003/0064773 | A1 | 4/2003 | Baerlocher et al. |
| 2003/0064795 | A1 | 4/2003 | Baerlocher et al. |
| 2003/0087693 | A1 | 5/2003 | Baerlocher et al. |
| 2003/0157982 | A1 | 8/2003 | Gerrard et al. |
| 2003/0211880 | A1 | 11/2003 | Locke |
| 2004/0009805 | A1 | 1/2004 | Baerlocher et al. |
| 2004/0023708 | A1 | 2/2004 | Kaminkow et al. |
| 2004/0043811 | A1* | 3/2004 | Seelig et al. ..... 463/16 |
| 2004/0106444 | A1 | 6/2004 | Cuddy et al. |

FOREIGN PATENT DOCUMENTS

| | | | |
|---|---|---|---|
| AU | 199917318 | A1 | 9/1999 |
| EP | 0 874 337 | A1 | 10/1998 |
| EP | 0926645 | A2 | 6/1999 |
| EP | 0 945 837 | A2 | 9/1999 |
| EP | 0944030 | A2 | 9/1999 |
| EP | 0981119 | A2 | 2/2000 |
| EP | 0 984 409 | A2 | 3/2000 |
| EP | 0984408 | A2 | 3/2000 |
| EP | 0984409 | A2 | 3/2000 |
| GB | 2 201 821 | A | 9/1987 |
| WO | WO 97/32285 | | 9/1997 |
| WO | WO 00/12186 | | 3/2000 |
| WO | WO 00/66235 | | 11/2000 |
| WO | WO 00/76606 | | 12/2000 |
| WO | WO 2004/012159 | | 2/2004 |
| WO | WO 2004/025584 | | 3/2004 |
| WO | WO 2005/099425 | | 10/2005 |

OTHER PUBLICATIONS

Ghost Hunter advertisement written by Atronic, published in 2003.
Magic 8 Ball advertisement written by IGT, published in 2003.
One page sheet showing and describing a 1977 Bally Monte Carlo game.
The Price is Right advertisement written by IGT, published in 2001.
Slot City "Anchor Games Unveils City of Slots," article written by Anchor Games published in 2001.
Slot Machines A Pictorial History of the First 100 Years, 5th ed., written by Marshall Fey, published in 1983.
Slots 2003 article written by Melissa Raimondi, published in Jan. 2003.
Wheel & Deal advertisement written by Anchor Games, Strictly Slots, published in Dec. 2001.
Wheel of Fortune advertisement written by IGT, published in 1999.
Wheel of Fortune Game Machine advertisement by IGT, published in 1998.
Wheel Poker advertisement written by Anchor Games/Bally Gaming, Strictly Slots, was written prior to Sep. 12, 2002.
A Vamp for All Seasons Article (IGT), written by Strictly Slots, published in 2002.
Addams Family Article (IGT), written by Strictly Slots, published in 2000.
Battleship Advertisement, printed from www.mikohn.com, on Apr. 25, 2001.
Battleship Article (Mikohn), written by Strictly Slots, published in 2000.
Boot Scootin Article, written by Strictly Slots, published prior to Jul. 2002.
Break the Spell Advertisement, written by Atronic Casino Technology, Ltd., published in 1999.
Break the Spell Article, written by Strictly Slots, published in Sep. 2000.
Break the Spell, printed from www.atronic.com on Jul. 15, 2001.
By George Advertisement, written by IGT, published in 2002.
Cash Chameleon Article, written by Strictly Slots, published in Apr. 2001.
Cash for Life—Offer Bonus Advertisement/Lotsa Loot Advertisement/Take It or Leave It Advertisement, written by Bally Gaming, published in 2002.
Cash for Life—Triple Spin Bonus Article (Bally Gaming), written by Strictly Slots, published in 2003.
Catch A Wave Advertisement, written by IGT, published in Dec. 2000.
Cossack Dance Advertisement, written by Olympic Video Gaming, published prior to 2002.
Deep Pockets Article (IGT), written by Strictly Slots, published in 2002.
Double Diamond Line Advertisement, written by Bally Gaming Systems, published in 2000.
Double Top Dollar Advertisement, written by IGT, published in 2003.
Enchanted Unicorn Advertisement, written by IGT, published in 2001.
Field Testing New Slots Article, written by Strictly Slots, published in Jul. 2000.
Fire and Fortune Article (Anchor Games), written by Strictly Slots, published in 2001.
Fishin' Buddies Article, written by Strictly Slots, published in Apr. 2001.
Fortune Cookie Advertisement, written by www.igt.com, printed Mar. 21, 2001.
Fortune Cookie Advertisement, written by IGT, published in 2000.
Happy Camper Advertisement, written by IGT, published in 2001.
Hollywood Advertisement, written by Shuffle Master Gaming, published in 2001.

Introducing the "Smiling Ape" Machine Advertisement (including Joker's Wild Poker description), written by IGT, published prior to 2001.
Jackpot Party Brochure and Articles, written by WMS Gaming, Inc, published in 1998.
Joker's Wild Advertisement, written by IGT, published prior to 2001.
King Cash Slots Advertisement, written by IGT, published in 2003.
Let's Make A Deal Advertisements, written by Bally Gaming/Shuffle Master Gaming, published in 2001.
Little Green Men, Jr. Advertisement, written by A.C. Coin, published prior to 2002.
Loco Loot Article, written by Strictly Slots, published in May 2002.
Mountain Money Article, written by Strictly Slots, published in Jun. 2002.
On the House Advertisement, written by Olympic Video Gaming, published prior to 2002.
Penguin Pays Advertisement, written by Aristocrat Incorporated, published in 1998.
Press Your Luck Article (Shuffle Master Gaming), written by Strictly Slots, published in 2000.
Price is Right—Cliff Hangers Description, printed from www.geocities.com on Mar. 21, 2001.
Price is Right—Cliff Hangers Advertisement, written by IGT, published in 2001.
Price is Right—Showcases Description, printed from schuminweb.com on Mar. 16, 2001.
Psycho Cash Beast Advertisement, written by IGT, published in 1999.
Reel Magic™ Gaming Machine Description, written by IGT, gaming machine available in 1986.
Symbol Feature Description in Australian UFO Gaming Machine, written by IGT, gaming machine available 1995.
Take Your Pick Advertisement, written by IGT/Anchor Gaming, published in 1999.
Take Your Pick Article (IGT), written by Strictly Slots, published in 2001.
The Latest Buzz Article, written by Bally Gaming Systems, published in Fall 2000.
Three Wishes Article (Atronic Americas), written by Strictly Slots, published in 2000.
Top Dollar Game Advertisement, written by IGT, published in 1998.
Wild Bear Salmon Run Advertisement written by IGT, published in 2003.
Wild Streak Article, written by Strictly Slots, published in 2001.
Your Real Key to Gaming Success Advertisement (including Roll Over Beethoven and Wild Fortune), written by Olympic Video Gaming, published prior to 2005.

* cited by examiner

GAMING DEVICE HAVING A MULTIPLE COORDINATE AWARD DISTRIBUTOR INCLUDING AWARD PERCENTAGES

PRIORITY CLAIM

This application is a continuation-in-part of and claims the benefit of U.S. patent application Ser. No. 10/630,529, filed Jul. 30, 2003 which is incorporated herein in its entirety.

CROSS-REFERENCE TO RELATED APPLICATIONS

This application is related to the following commonly-owned co-pending patent applications: "GAMING DEVICE HAVING A MASKED AWARD GAME," Ser. No. 10/210,540, and "GAMING DEVICE HAVING AN OFFER AND ACCEPTANCE GAME," Ser. No. 11/122,719.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Gaming device manufacturers strive to make gaming devices that provide as much enjoyment and excitement as possible. Providing a secondary or bonus game in which a player has an opportunity to win potentially large awards or credits in addition to the awards associated with the primary or base game of the gaming device is one way to enhance player enjoyment and excitement.

Gaming devices having bonus games generally employ a triggering event that occurs during the base game operation of the gaming device. The triggering event temporarily stalls or halts the base game play and enables a player to enter a second, different game, which is the bonus game. The player plays the bonus game, likely receives an award, and returns to the base game.

One known bonus game is in the WHEEL OF FORTUNE® gaming device manufactured by the assignee of this application. In this game, a multi-colored award wheel is attached to a cabinet of the gaming device. The award wheel is divided into several sections. Each section includes an award that ranges in value from twenty to one thousand. In this game, a player plays a base game that includes spinning reels and a central payline. When the wheel symbol is positioned along the central payline on the third reel, the player enters the bonus game.

In the bonus game, the player obtains one opportunity or spin of the award wheel. The player spins the award wheel by pressing a button on the gaming device. Once the award wheel starts spinning, the player waits until it stops. An indicator located at the top of the award wheel points to a section of the wheel. The player receives the award on that section for the bonus game. After the player receives that award, the bonus game ends and the player can resume playing the base game.

Another known game is described in U.S. Pat. No. 6,059,658 to Mangano et al. This patent relates to a spinning award wheel game. The game includes a display having five concentrically arranged wheels. Each wheel has indicia designated with an Ace, King, Queen, Jack, Ten and a wild symbol along the outer edge of the circles. Once a player enters the game, the player initiates the spinning of the wheels. Each wheel rotates independently of the other wheels. The object of the game is to align winning combinations of indicia, which in this game are winning hands in poker. A indicator points to a sequence of five indicia formed from each of the five rotating wheels. If the sequence equals a winning combination, the player receives an award.

To increase player enjoyment and excitement, therefore, it is desirable to provide new bonus games having award wheels that provide larger awards to players with minimal risk.

SUMMARY OF THE INVENTION

The present invention provides a gaming device and in particular a bonus game of a gaming device that enables players to accumulate awards by obtaining sections on an award distributor such as an award wheel based on the coordinates of the sections.

In one embodiment, the award wheel includes several annular areas or groups that are each divided into a plurality of sections. The sections are each defined by first and second coordinates on the award wheel and include award symbols that are associated with awards. The coordinates define the location of each section on the award wheel. Initially, the gaming device alternately illuminates each annular area, which defines the first coordinate of the groups of sections in the annular areas. In one embodiment, the gaming device picks one of the annular areas. In another embodiment, the gaming device enables the player to pick one of the annular areas where the awards associated with the annular areas are approximately equal. Once the first coordinate is defined by selecting one of the annular areas on the award wheel, the gaming device or player activates or spins the award wheel. When the wheel stops spinning, a section indicator indicates a second coordinate which together with the first coordinate, defines the determined section in the annular area. The player receives the award associated with the section that is defined by the indicated first and second coordinates. In one embodiment, the player continues to play the bonus game until the player is out of activations or spins of the award wheel.

In one preferred embodiment, the award wheel is divided into several groups or annular areas where each of the annular areas is further divided into several sections. The first coordinate of a group of sections is represented by the radial distance from the center of the award wheel to the annular area. The second coordinate of one of the sections in the group is defined by the angular location of a section along the annular area. Each section includes a symbol such as an award symbol. A plurality of awards are associated with the award symbols. In one embodiment, the awards associated with the sections in the innermost annular areas of the award wheel are substantially lower awards than the awards associated with the sections located in the outermost annular areas of the wheel. Each annular area is alternately highlighted or illuminated at the start of the bonus game by an illumination device. The annular areas alternately light up, one at a time, until only one area is randomly selected and remains illuminated. In one embodiment, the gaming device (i.e., the processor) determines the indicated annular area. In another embodiment, the gaming device enables the player to pick the annular area as described above. Next, the gaming device or player activates or spins the award wheel. Once the wheel stops spinning, the section indicator indicates one of the sections in the indicated or highlighted annular area. The player receives the award associated with the indicated section. The player continues to play the bonus game until the player has no spins remaining in the game.

In another embodiment, the award wheel first is spun to indicate a pie-shaped area of the wheel. Each pie-shaped section is further divided into individual sections by the annular areas on the wheels. Then, the sections in the indicated pie-shaped area are alternately illuminated until one section is randomly selected and remains illuminated. The player receives the award associated with that selected section.

In a further embodiment, an annular area is illuminated and defines the first coordinate of a group of sections. Then the indicator spins about the perimeter of the award wheel to define the second coordinate of one of the sections in the illuminated annular area. When the indicator stops, the indicated first and second coordinates define the indicated section on the award wheel. The gaming devices provides the player with the award associated with the indicated section defined by the determined first and second coordinates.

In an alternative embodiment of the present invention the sections on the award wheel include a plurality of awards and a plurality of award percentages. Specifically, the award wheel includes a plurality of sections wherein the sections are arranged in a plurality of groups. The groups of sections include a symbol group, which includes the sections in the outermost annular area and a plurality of modifier groups, which include the sections in inner annular areas.

In one embodiment, a plurality of awards, such as award values or credits, are associated with the sections in the symbol group. The awards may include values, multipliers, modifiers, monetary prizes, non-monetary prizes, physical prizes or any suitable type of award. It should be appreciated that any of the annular areas or groups on the award wheel may include sections having one or more awards.

Additionally, a plurality of award portions or award percentages are associated with the sections in the modifier groups. In one embodiment, the modifier groups include award percentages of 100%, 75%, 50% and 25% associated with each of the sections in these groups. The award percentages may be any suitable award percentages desired by the game implementor. In one embodiment, the award percentages associated with the sections in each of the modifier groups are the same. In another embodiment, the award percentages associated with the sections in each of the modifier groups are different. It should be appreciated that at least one of the award percentages, a plurality of the award percentages or all of the award percentages associated with the sections within each of the groups may be different. Additionally, the award percentages associated with the sections may be different from group to group. In one embodiment, the award percentages associated with the sections in the groups increase from the innermost annular area to the outermost annular area. In another embodiment, the award percentages decrease from the innermost modifier group to outermost modifier group. Furthermore, the award percentages may be represented as fractions, decimals or any other suitable type of award portion, fraction or percentage.

In an operational embodiment, the gaming device indicates an award percentage and an award in each activation or spin of the award wheel. The indicated award percentage is multiplied by the or applied to an indicated award in the symbol group to provide an activation or spin award to the player for that activation or spin. For example, when an indicated section includes an award percentage of 75% (0.75), the gaming device provides the player with 75% of the award associated with the indicated section in the symbol group. In other words, the gaming device multiplies the indicated award by 0.75 to provide an activation award to the player for that activation or spin.

In one embodiment, each of the modifier groups are included on the same wheel and rotate in the same direction. In another embodiment, at least one of the modifier groups is included on a separate wheel from the other annular areas. In this embodiment, the wheels may rotate in the same direction or in different directions. In a further embodiment, each of the modifier groups are included on separate wheels. The wheels may rotate in the same direction, at least one may rotate in different directions from the other wheels or a plurality of the wheels may rotate in a different direction. In a further embodiment, the award wheel may also remain stationary and the section indicator may rotate about the perimeter of the award wheel in a clockwise or counter-clockwise direction.

The gaming device also includes an additional bonus award such as a big bonus award. In one embodiment, the big bonus award is indicated in the middle of the award wheel includes a masked or hidden award provided to the player by the gaming device when all of the award percentages associated with a particular award are indicated in the game (i.e., in the number of spins of the wheel provided to the player). The big bonus award may be an award value, a modifier, a multiplier, free spins, free games or any other suitable award. The big bonus award is provided to the player in the game or in a subsequent game (i.e, free spins) or added to the player's total award in the game (i.e, an award value or credits).

In another embodiment, the gaming device enables a player to pick or select an annular area or pie-shaped area or segment of the wheel prior to playing the game or initiating the spins of the wheel in the game. It should be appreciated that the gaming device may enable the player to pick one or a plurality of the annular areas and/or pie-shaped segments or areas of the wheel in a game. It should also be appreciated that the gaming device may enable the player to pick the annular area or areas or pie-shaped section or sections prior to playing the game, prior to one spin in the game or prior to a plurality of the spins in the game. In one embodiment, the gaming device enables the player to pick one of the annular areas or pie-shaped sections by pressing or touching the corresponding annular area or pie-shaped section on a touch screen display device or by pressing a button or similar input device which corresponds to the annular area or pie-shaped section on the wheel.

In a further embodiment, the gaming device of the present invention is employed in a progressive type game where a player accumulates indicated sections on the wheel in a plurality of games. In this embodiment, the indicated sections remain highlighted or illuminated for a designated number of games. The designated number of games may be predetermined, randomly determined or determined in any suitable manner. In one aspect of this embodiment, the awards are associated with a probability of being indicated such that the relatively small awards include greater probabilities than the relatively large awards. In this aspect, a significant portion of the relatively small awards are indicated before the relatively large awards are indicated on the wheel. Once the designated number of games are reached, the gaming device resets the award wheel so that none of the sections are indicated (i.e., highlighted) on the wheel. It should be appreciated that the gaming device may reset the award wheel so that none, one, a plurality or all of the sections are highlighted on the wheel.

In another embodiment, a plurality of section indicators are associated with the wheel such that multiple sections are indicated on the wheel in a spin. This enables a player to obtain multiple awards associated with the multiple sections indicated on the wheel in a single spin. In one embodiment, the section indicators associated with the wheel are activated such that only the activated section indicators indicate sections on the wheel. The section indicators may be activated by particular sections on the wheel or based on the number of spins provided to the player in the game. The number of section indicators may also be based on a wager made by the player in the base game or in a bonus game.

In a further embodiment the multiple section indicators are moveable such that the section indicators move about the wheel at the beginning of a game and are stopped or locked in place by the gaming device or the player. The section indicators may move at the beginning of the game, during the game, after one spin or a plurality of the spins of the wheel or at any suitable point in a game. The moveable indicators enable the player to interact with the game and therefore provides additional excitement and enjoyment of the game.

In another embodiment, a time dimension is associated with the present invention to offer enhanced play and awards in the game. In one aspect of this embodiment, a larger award or a plurality of awards are provided to the player when a designated number of sections are indicated in a designated number of spins of the wheel. For example, the gaming device provides a larger award or a bonus award to a player when the player indicates all of the sections associated with one of the awards in a particular number of spins of the award wheel. The gaming device decreases the award for each additional spin or spins needed by the player to indicate those sections.

In another aspect of this embodiment, the gaming device only provides a bonus award when the player indicates a specific section or sections in a designated number of spins. If the sections or sections are indicated after the designated number of spins are reached, the gaming device does not provide a bonus or extra award to the player. It should be appreciated that the designated section or sections may be predetermined, randomly determined or determined according to any suitable determination method.

In a further aspect of this embodiment, a time period is associated with the game such that the gaming device or the player spins the wheel during the time period and indicates sections and accumulates awards associated with those sections during the time period. When the time period expires, the game ends and the player receives the total accumulative award for the game.

The present invention may be employed in a primary or base game or, a secondary or bonus game or any suitable type of game such as poker, blackjack, roulette, dice, slots, multi-line slots or any other suitable wagering game.

It is therefore an advantage of the present invention to provide a gaming device having a multi-coordinate wheel with an alternating bonus award where awards and award percentages are associated with multi-coordinate locations on the award wheel.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
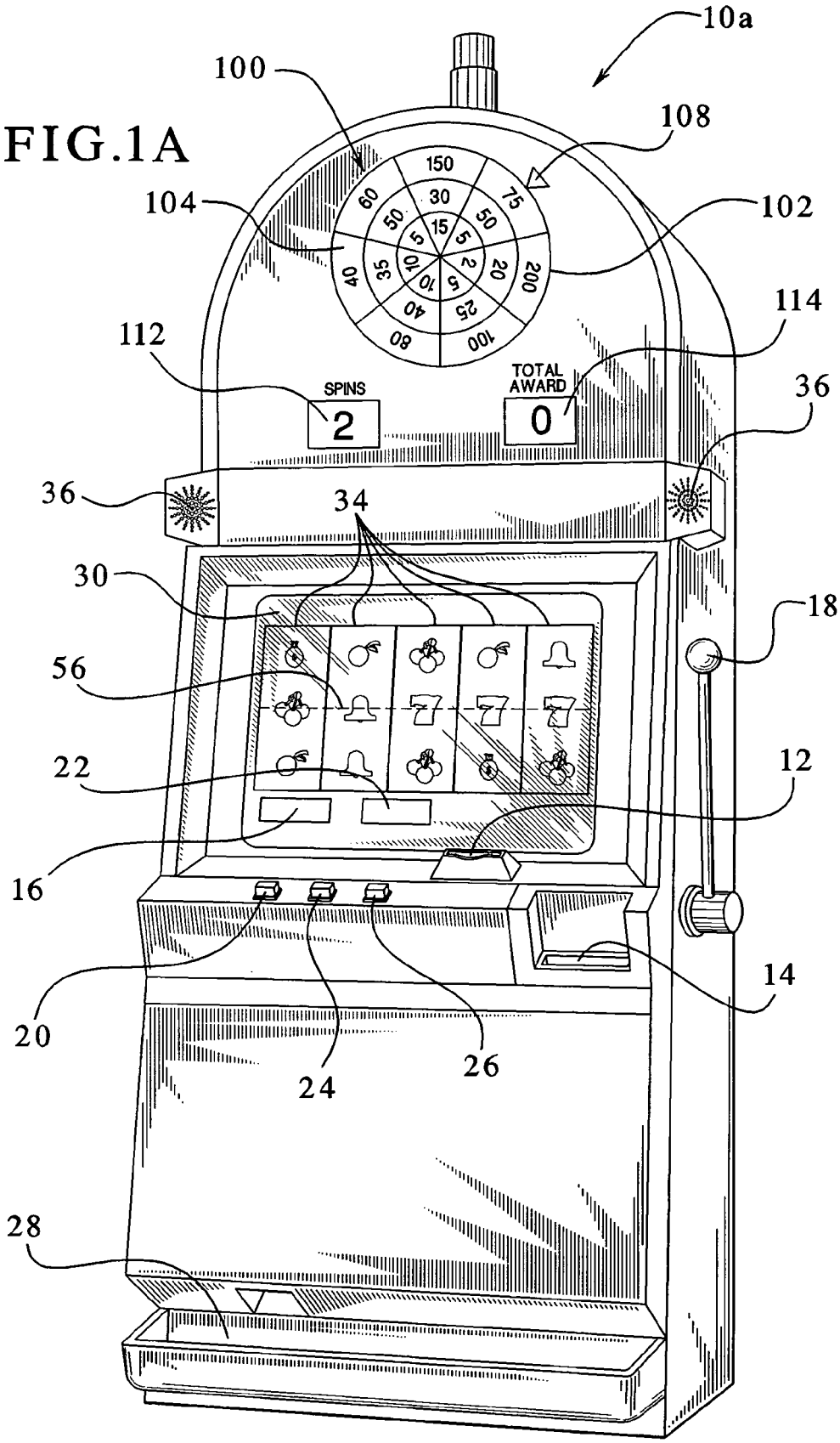
FIG. 1A is a front perspective view of one embodiment of the gaming device of the present invention which includes a mechanical multi-coordinate award wheel.
Figure 1B:
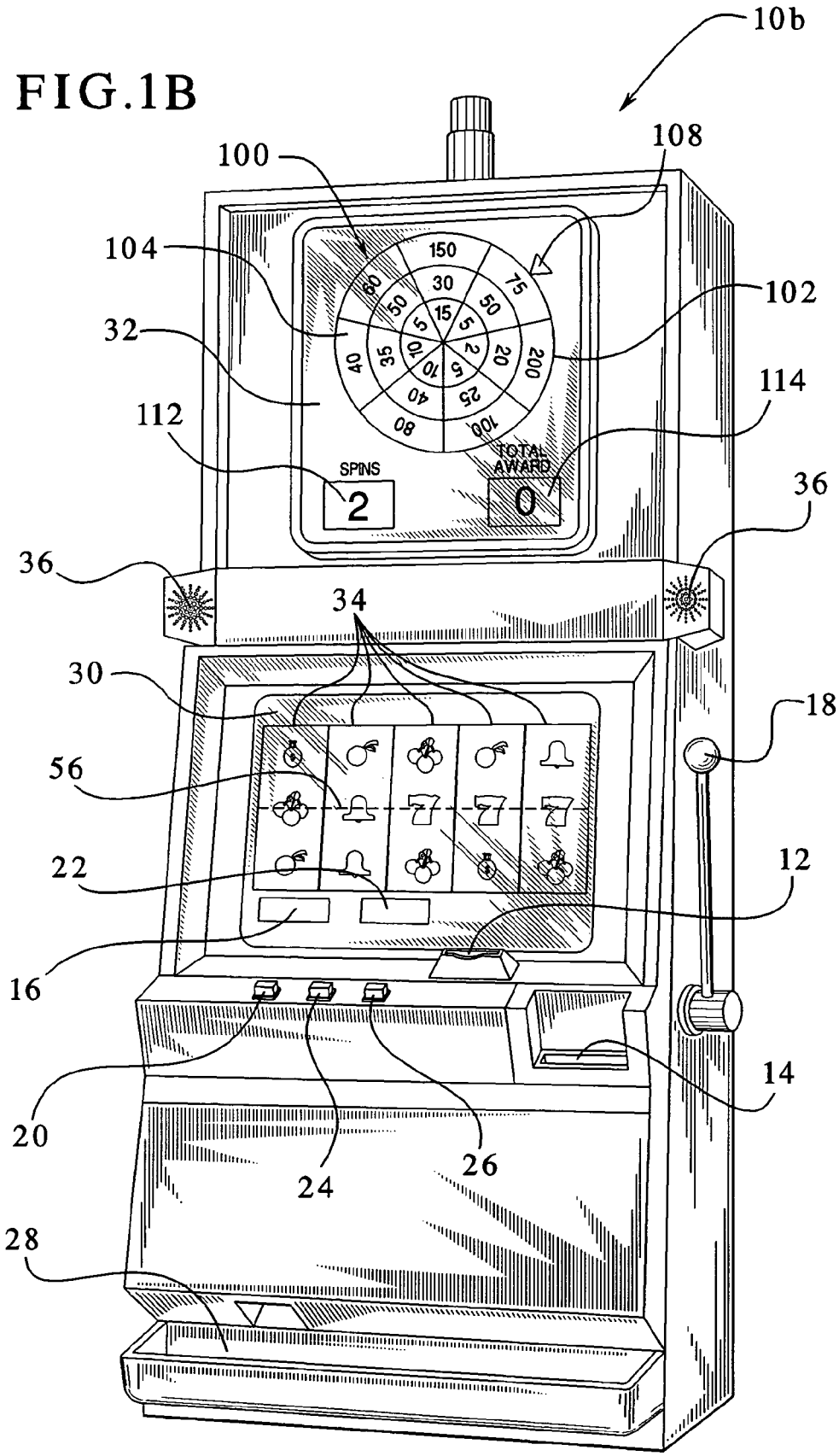
FIG. 1B is a front perspective view of another embodiment of the gaming device of the present invention which includes a multi-coordinate award wheel in a video format.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sifting, and gaming device 10 is preferably mounted on a console. However, it should be appreciated that gaming device 10 can be constructed as a pub-style table-top game (not shown) which a player can operate preferably while sifting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, black jack, poker or keno, any of the bonus triggering events and any of the bonus round games. The symbols and indicia used on and in gaming device 10 may be in mechanical, electrical, electronic or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

A player may cash out and thereby receive a number of coins corresponding to the number of remaining credits by pushing a cash out button 26. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30 and a mechanical multi-coordinate award wheel 100 that physically spins in front of a player. The award wheel is divided into a plurality of annular areas 102 that are further divided into sections 104 where each section is indicated by a section indicator 108. The alternative embodiment shown in FIG. 1B includes a central display device 30 as well as an upper display device 32. The upper display device 32 displays the multi-coordinate award wheel 100 of the present invention in a video format.

Gaming device 10 in one embodiment preferably displays a plurality of reels 34 such preferably three to five reels 34 in mechanical or video form, on one or more of the display devices. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
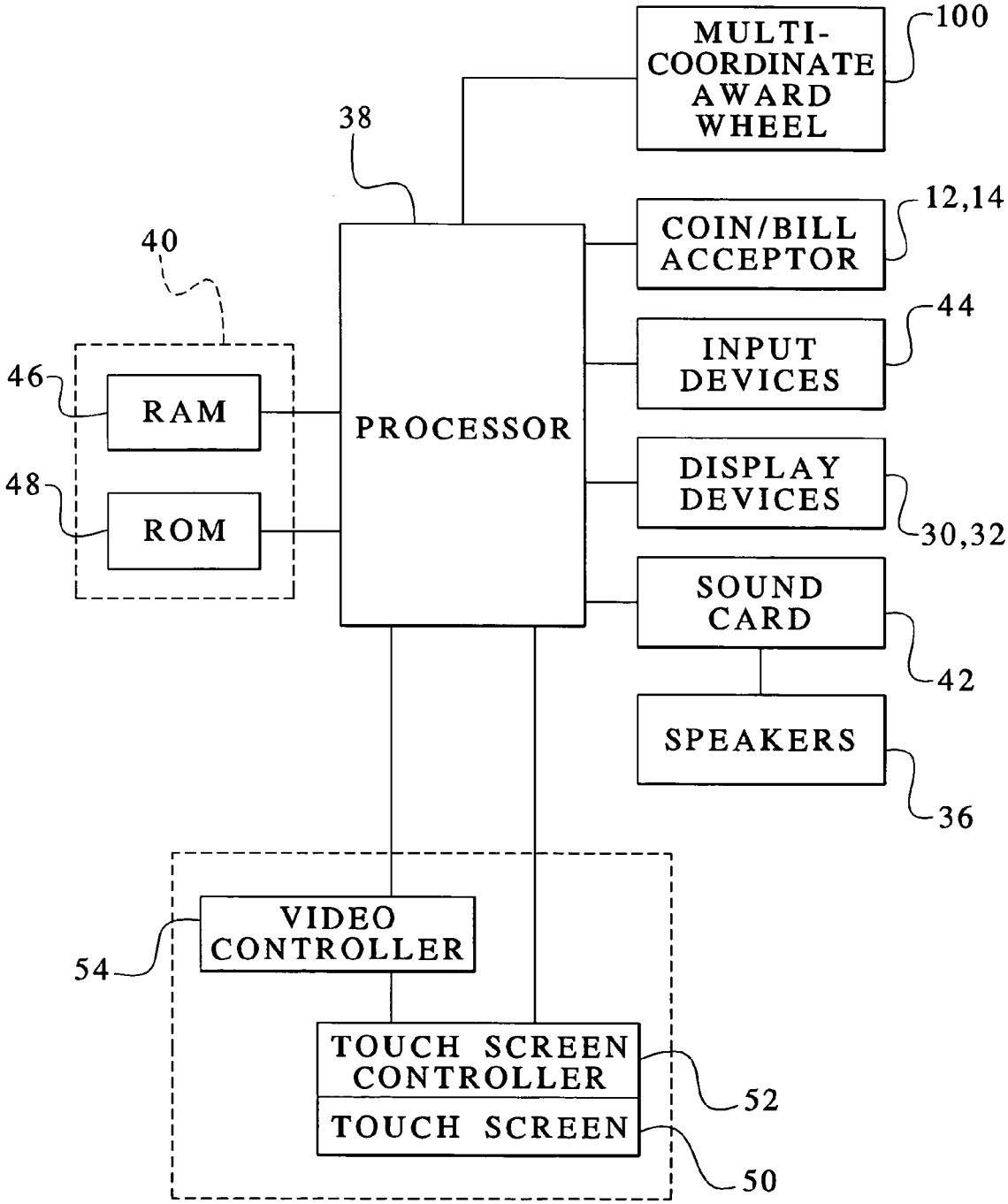
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; one or more input devices 44; and an optional mechanical multi-coordinate award wheel 100. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively or alternatively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on one or more of a plurality of the reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Bonus Game

Figure 3:
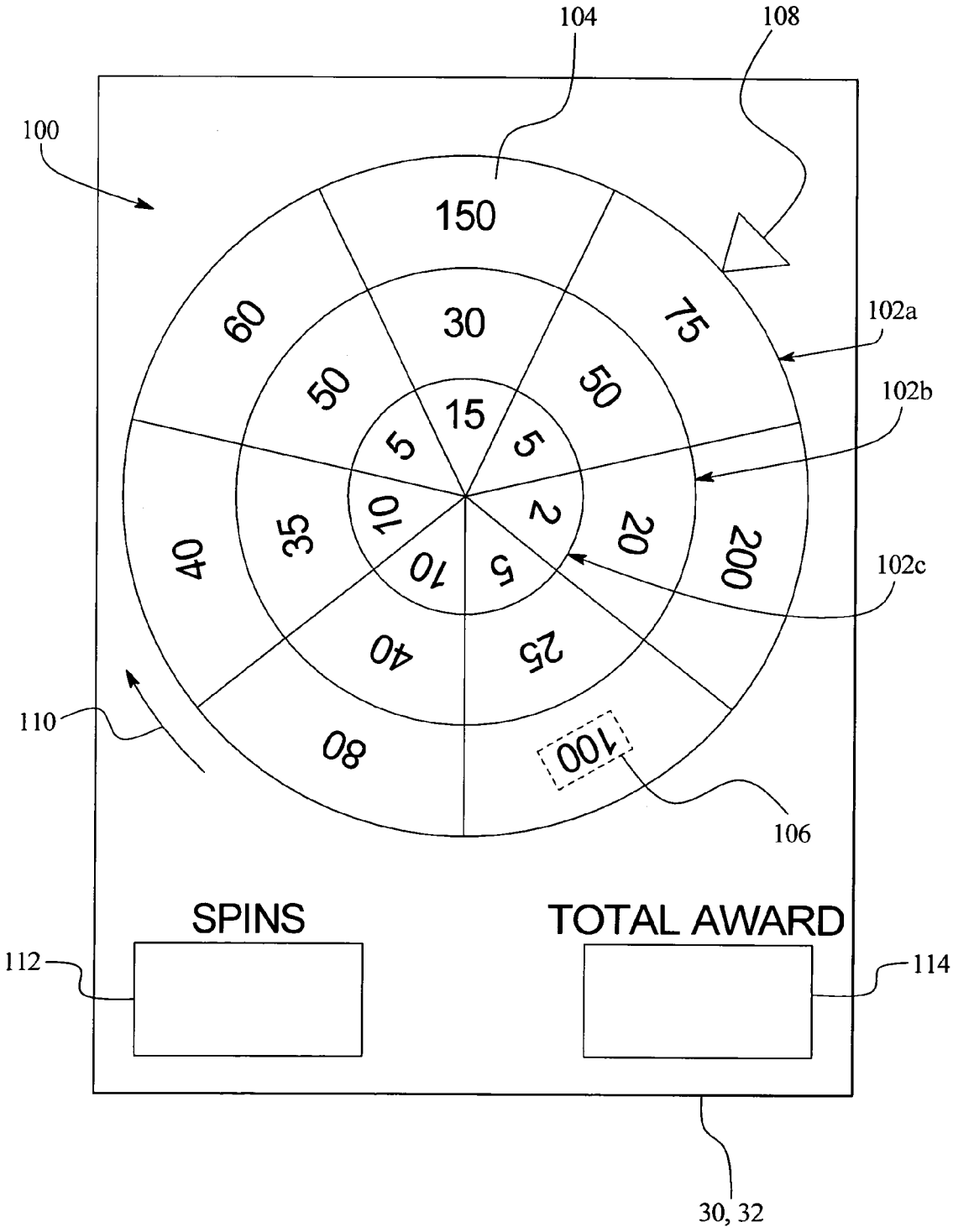
FIG. 3 is an enlarged elevation view of a display device illustrating one embodiment of the present invention.

Referring to FIG. 3, the gaming device 10 includes an award distributor such as a multi-coordinate award wheel 100. In one embodiment, the award wheel 100 is displayed on a video display device such as display device 32 in FIG. 1B. In another embodiment, the award wheel is a mechanical wheel that is physically attached to the gaming device. The award wheel 100 is divided into multiple annular areas 102 where any suitable number of annular areas may be employed by the game implementor. Each annular area 102 is divided into a plurality of sections 104. An award 106 or award symbol is associated with each section 104. In one embodiment, a bonus number of credits is associated with each award symbol. However, it should be appreciated that an award does not have to be associated with each section and that a multiplier, zero award, negative award or other type of modifier may be associated with one or more awards or award symbols on the award wheel.

In operation, the multi-coordinate award wheel alternately illuminates the annular areas 102*a* to 102*c*. In one embodiment, the gaming device randomly stops on one annular area 102. In another embodiment, a player presses a button or similar input to select an annular area. Once a annular area is determined or selected, the award wheel spins or rotates in a clockwise direction as shown by arrow 110 to indicate a section 104. It should be appreciated that the award wheel can also spin in a counter-clockwise direction if desired. It should also be appreciated that the award wheel and sections thereof may be different shapes and sizes.

A section indicator 108 is positioned adjacent to the outer edge of the award wheel 100. The indicator 108 indicates or points to one of the sections 104 of the award wheel. In FIG. 3, the section indicator 104 is an arrow-shaped component that is positioned along the outer edge of the award wheel 100. It should be appreciated that the section indicator may also include an illumination device that lights up or highlights a section 104 similar to how the annular sections 102 are highlighted. An illumination device may be associated with each section or with all of the sections. It should also be appreciated that the award wheel may be stationary and the indicator may move around the perimeter of the wheel. Alternatively, both the award wheel and the indicator may move at different rates, or in different directions or at different rates in different directions.

The gaming device preferably includes a spin remaining display 112 and a total award display 114. The spin remaining display 112 indicates the number of spins that are remaining in a game. The total award display 114 indicates the value of the bonus awards that the player has accumulated during the bonus game. When the player runs out of spins, the bonus award identified in the total award display 114 is transferred to the player's credit display in a conventional manner.

Referring now to FIGS. 4A through 4F, an example of one embodiment of the present invention is illustrated where the gaming device provides a player with three spins to start the bonus game. In this example, the multi-coordinate award wheel 100 has three annular areas 102*a*, 102*b*, 102*c*, and several sections 104 that include awards 106.

Figure 4A:
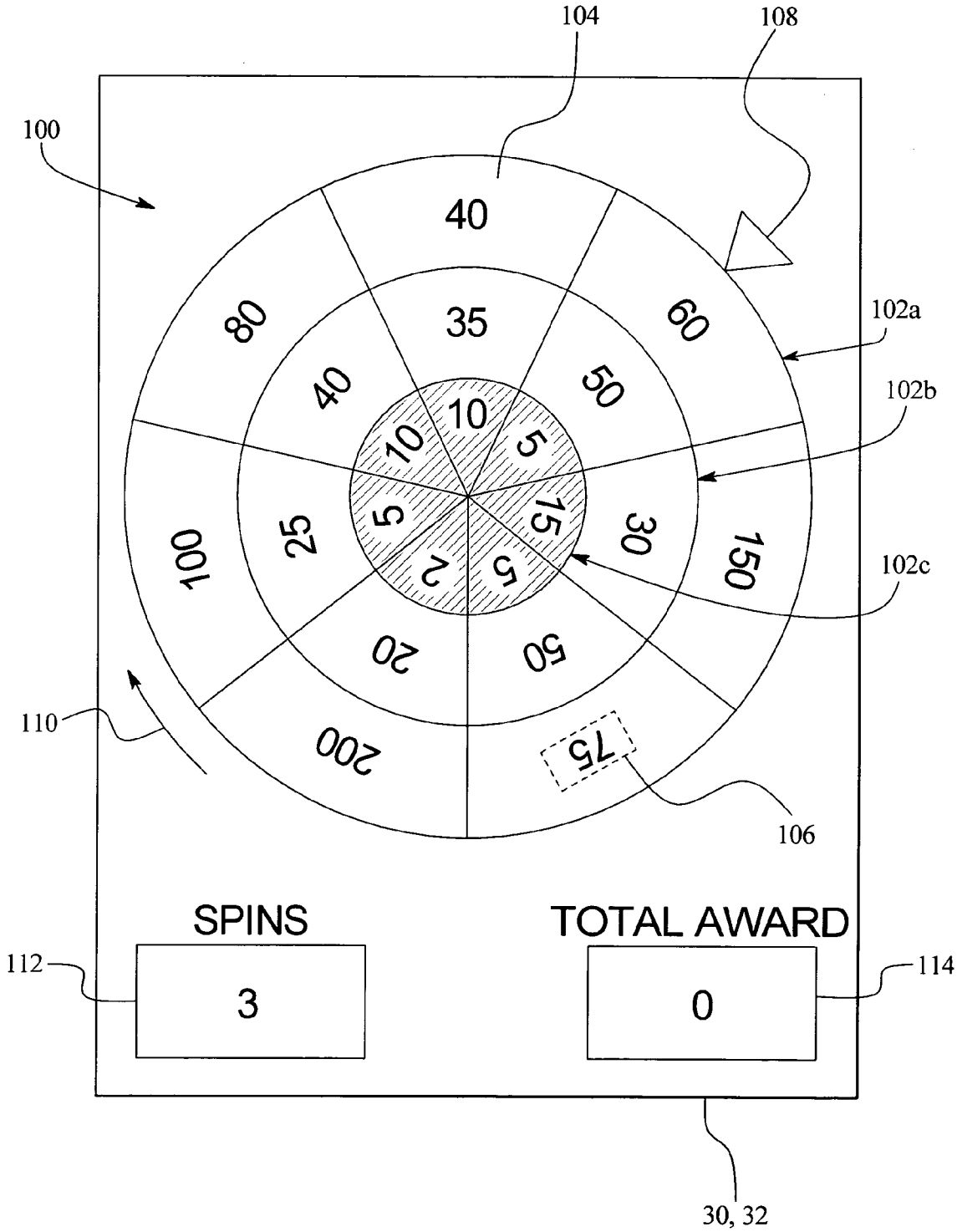
FIGS. 4A, 4B, 4C 4D, 4E and 4F are enlarged elevation views of a display device of the present invention illustrating three spins of the multi-coordinate award wheel in the bonus game.

Referring to FIG. 4A, the gaming device displays several sections 104 on an award wheel 100, where each section has a coordinate location on the award wheel 100. In this example, the coordinate location of each section is defined by a radial coordinate and an angular coordinate. The radial coordinate defines a sections' radial distance from the center of the award wheel or the annular area 102 that contains the section. The angular coordinate defines the location of the section along the perimeter of the award wheel. It should be appreciated that the coordinates of a section may be predefined or randomly determined by the processor. It should also be appreciated that the coordinates may be any coordinates defined by the game implementor.

At the start of the bonus game, the gaming device alternately illuminates the annular areas 102*a* to 102*c*. The areas illuminate one at a time where area 102*a* illuminates first, followed by area 102*b* and 102*c*. The gaming device repeats this sequence until a radial coordinate or annular area 102 is determined. It should be appreciated that the areas 102 may illuminate in any order or sequence desired by the game implementor. The gaming device stops alternately illuminating the areas after determining the radial coordinate of a section. In another embodiment, a player input determines the radial coordinate.

After the radial coordinate is identified or indicated, the gaming device spins the award wheel 100 to determine the angular coordinate of the award section. It should be appreciated that the player may physically spin the award wheel 100 to determine the angular coordinate of the award section. The gaming device spins the award wheel 100 in a clockwise direction as shown by arrow 110. After the award wheel 100 stops spinning, the symbol indicator 108 indicates a section 104, which is defined by the radial coordinate and the angular coordinate of the section. The gaming device provides an award 106 associated with the indicated section 104. The award is transferred to the total award display 114 and the gaming device or player spins the award wheel 100 again if the player has picks remaining in the game as indicated by pick display 112.

Figure 4B:
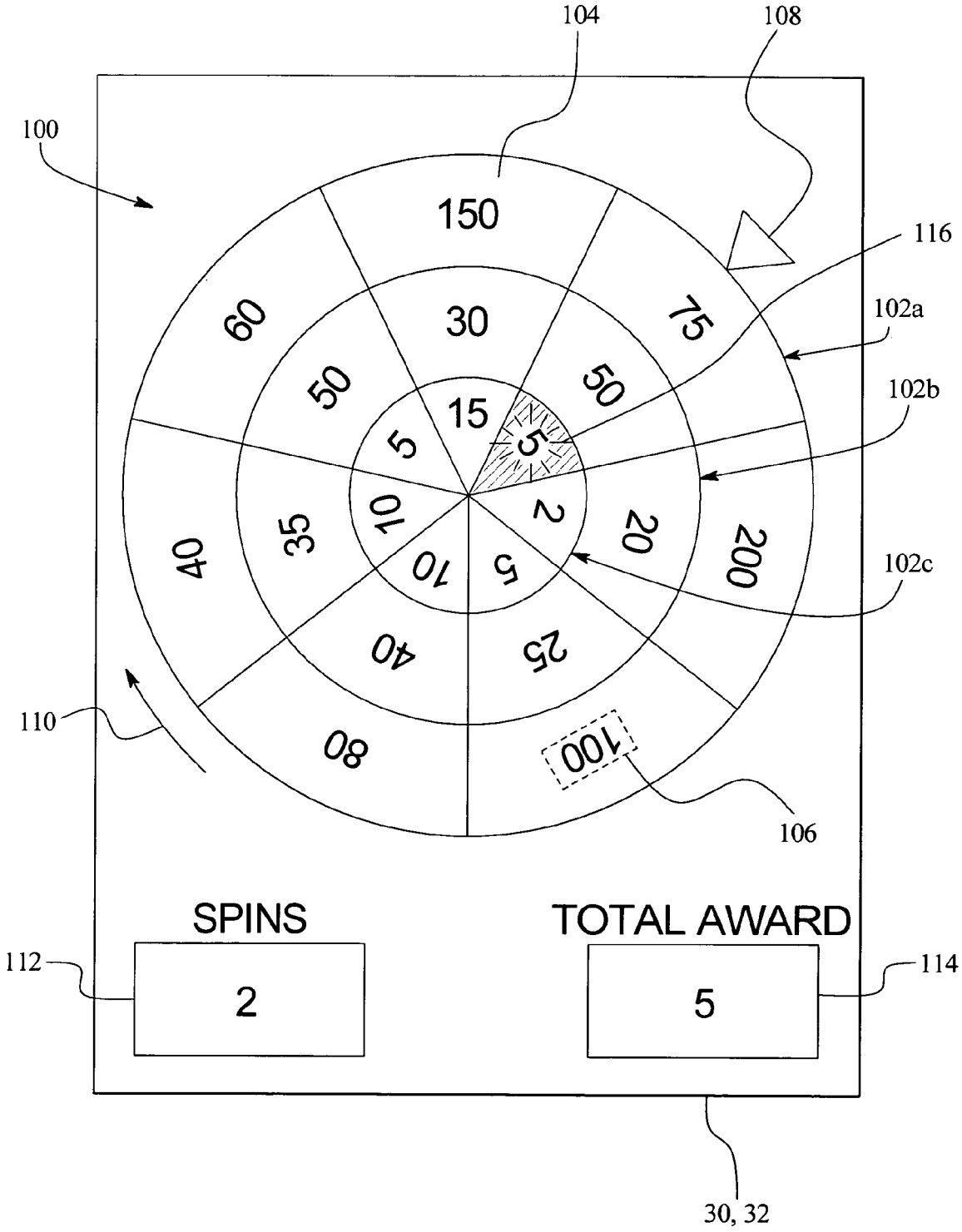

In FIG. 4A, the gaming device alternately illuminates the annular areas 102, and stops on annular area 102*c* or the innermost annular area of the multi-coordinate award wheel 100. Referring to FIG. 4B, the gaming device spins the award wheel in a clockwise direction to determine the angular coordinate of a section included in the annular area 102*c*. The section indicator 108 indicates section 116 in annular area 102*c*. An award of five is associated with section 116 and this award is transferred to the total award display as indicated by display 114. The player has two spins remaining in the bonus game.

Figure 4C:
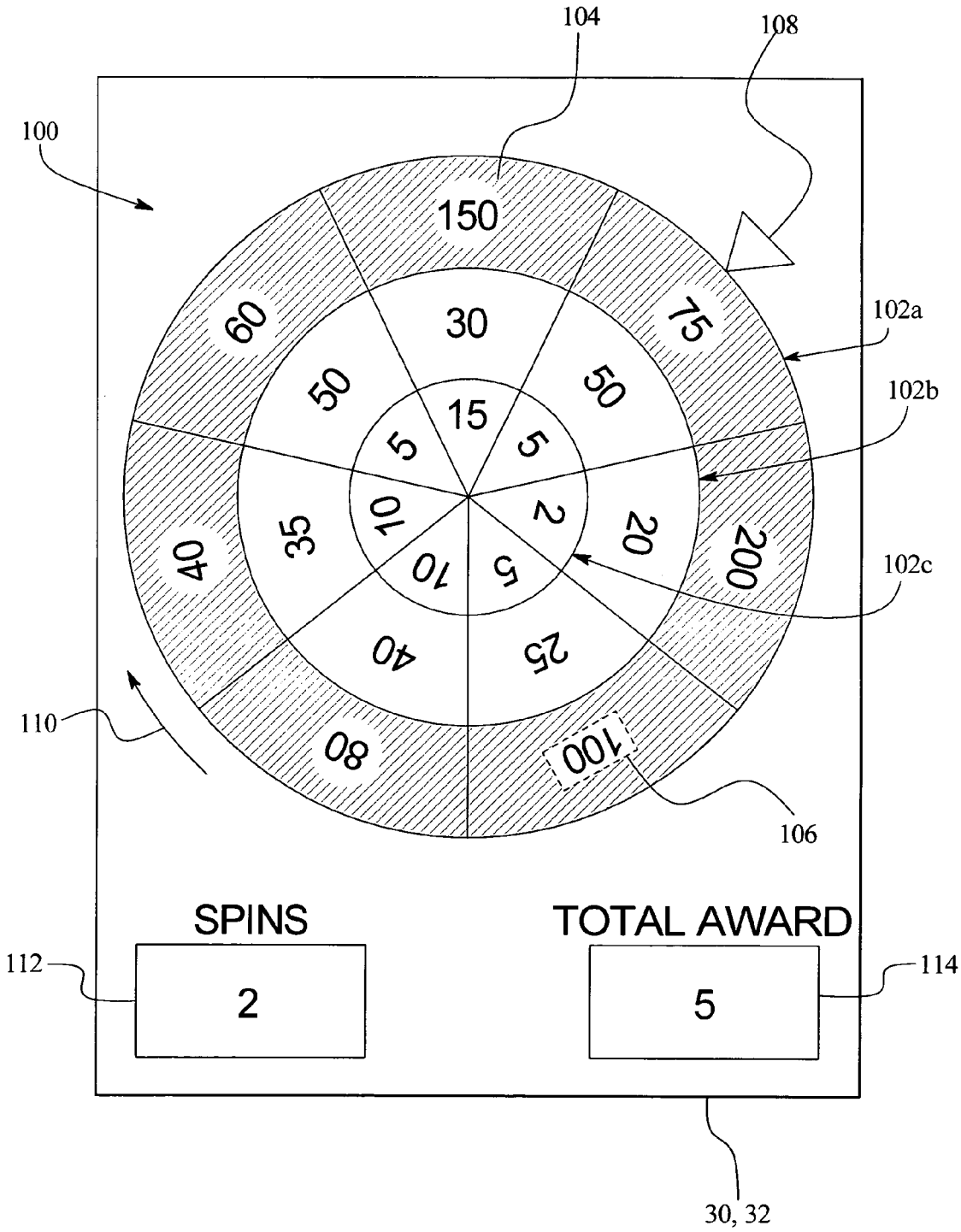
Figure 4D:
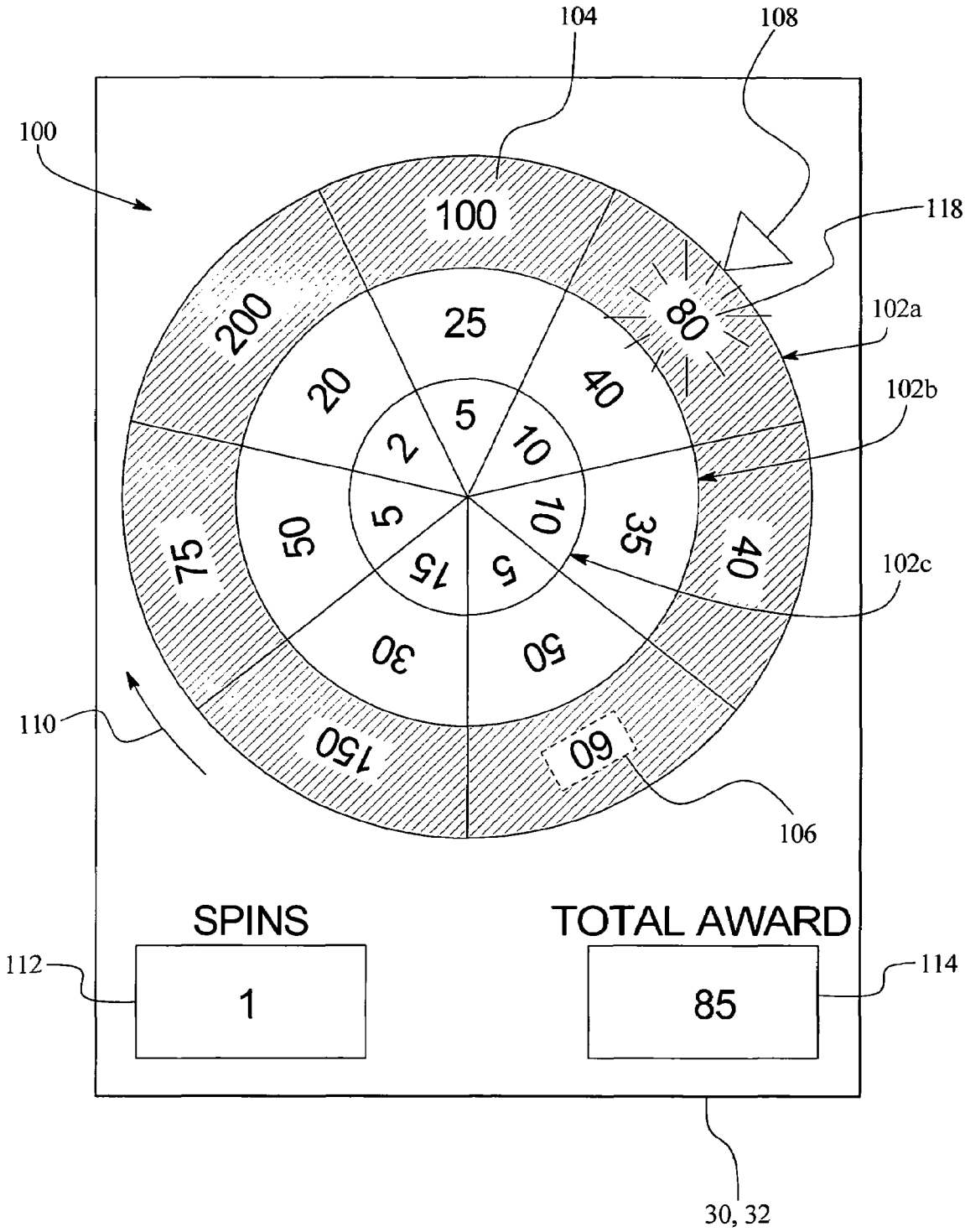

Referring now to FIG. 4C, the gaming device alternately illuminates the annular areas 102*a*, 102*b* and 102*c* again. A radial coordinate or annular area 102 is determined by the gaming device, which is annular area 102*a*. Annular area 102*a* remains illuminated while the gaming device spins the award wheel 100. In FIG. 4D, the award wheel stops spinning and the section indicator 108 indicates a section in the annular area 102*a*. Section 118 is indicated by the indicator and the player receives an award of eighty associated with that section. The award, eighty, is transferred and added to the award indicated by the total award display 114 to give the player a new total award of eighty-five. The player has one spin remaining in the bonus game as indicated by pick display 112.

Figure 4E:
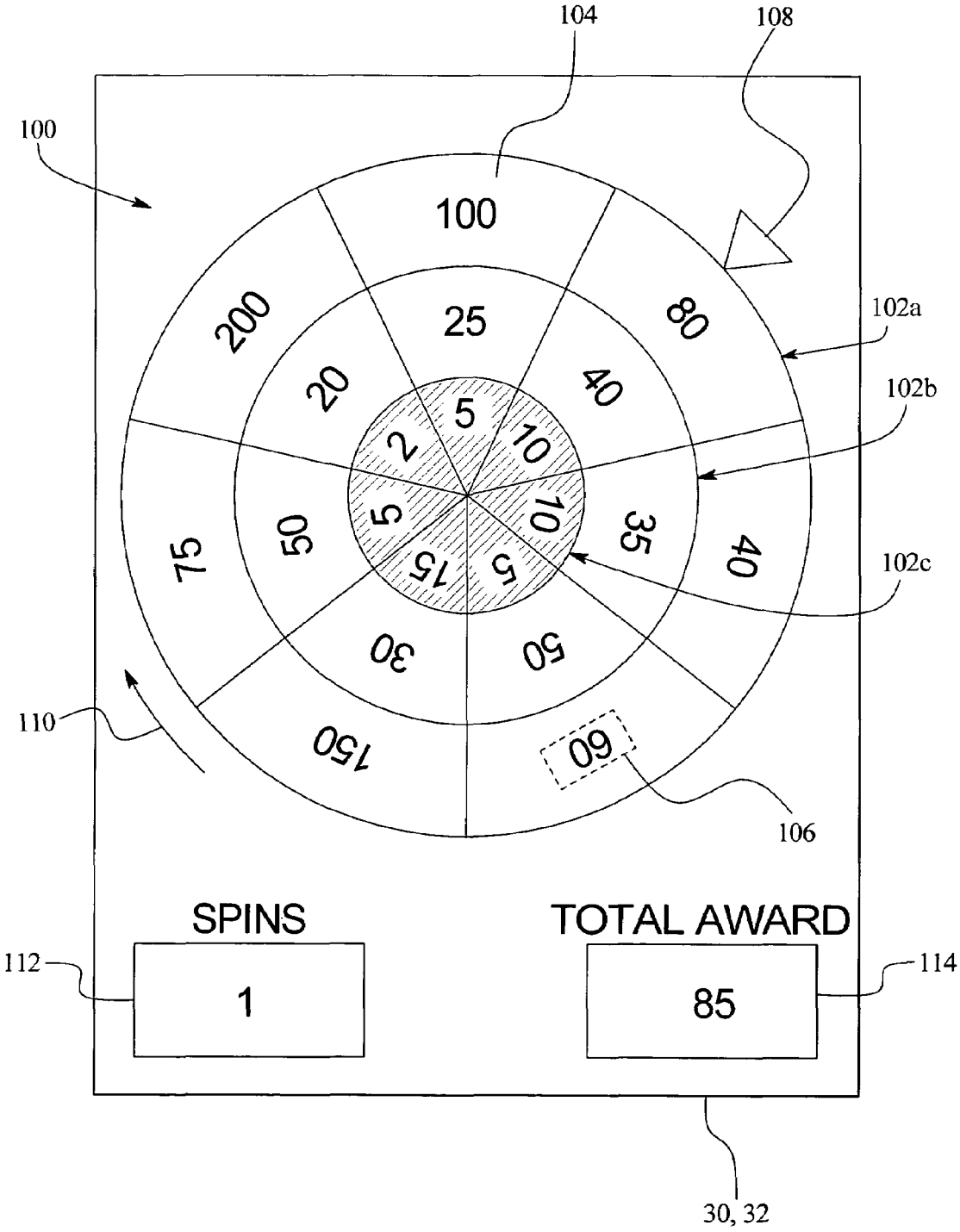
Figure 4F:
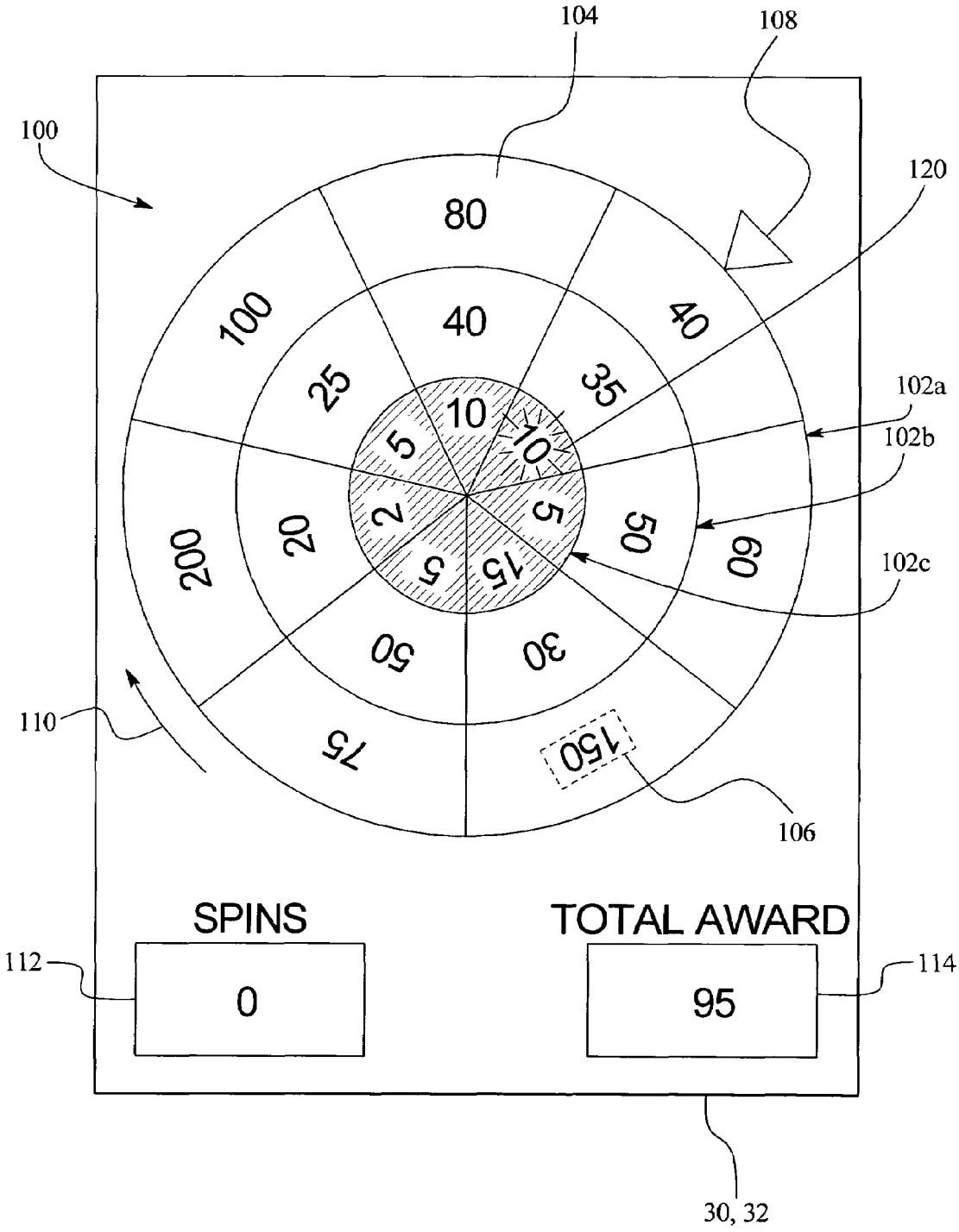

Referring now to FIG. 4E, the gaming device alternately illuminates the annular areas 102 until selecting area 102*c*. Annular area 102*c* remains illuminated and the gaming device spins the award wheel 100. In FIG. 4F, once the award wheel stops, the section indicator 108 indicates section 120. An award of ten associated with section 120 is transferred and added to the total award displayed in the total award display 114. The new total award equals ninety-five as indicated by the total award display 114. The player does not have any spins remaining as indicated by spin display 112 and therefore, the bonus game ends.

Figure 5:
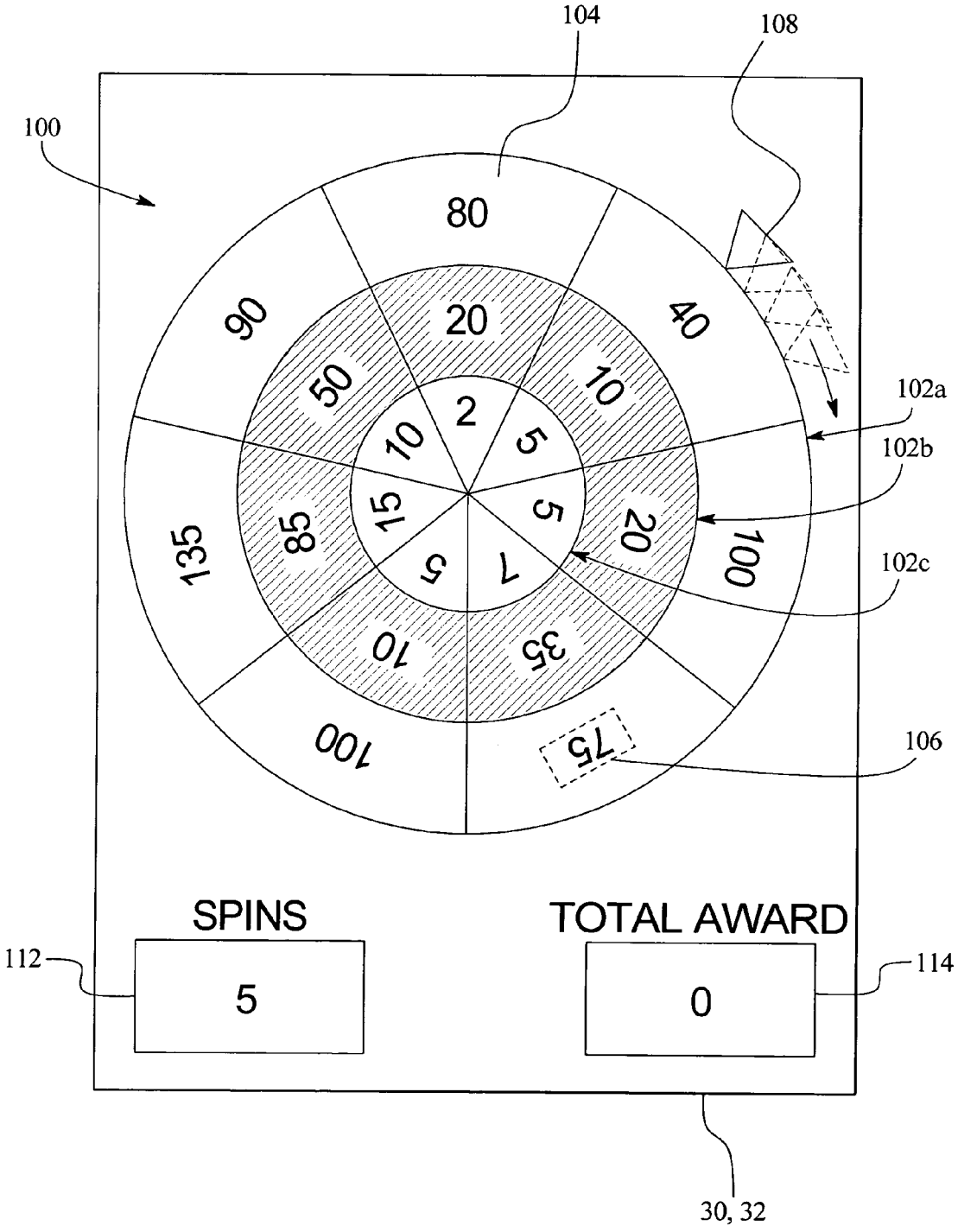
FIG. 5 is an enlarged elevation view of another embodiment of the present invention where the section indicator moves about the perimeter of the multi-coordinate award wheel.

Referring now to FIG. 5, another embodiment of the present invention is illustrated where the multi-coordinate award wheel is stationary and the section indicator 108 moves in a clockwise direction along the perimeter of the award wheel. In this embodiment, the section indicator 108 may move in a clockwise or counter clockwise direction to indicate a section 104.

Figure 6:
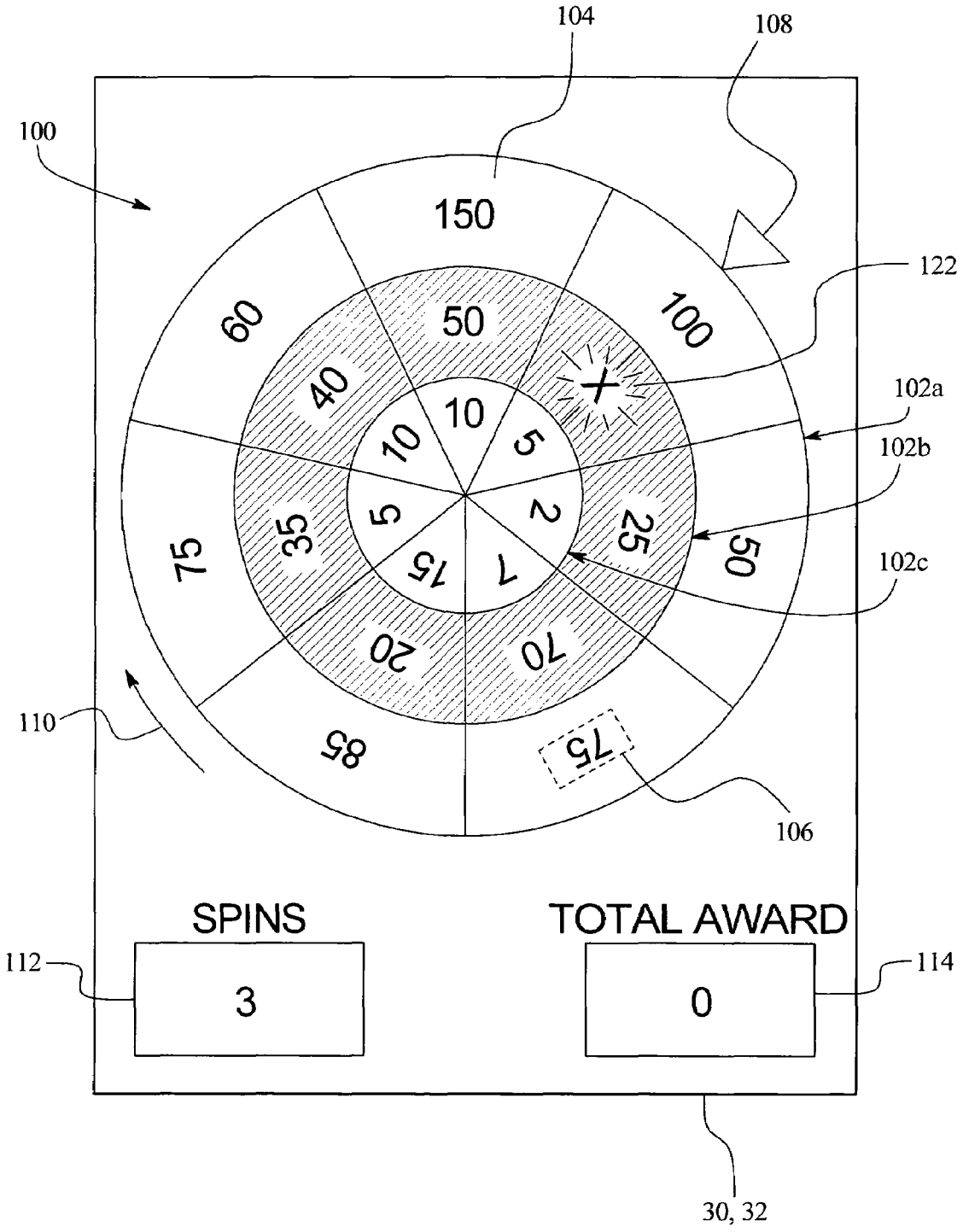
FIG. 6 is an enlarged elevation view of a further embodiment of the present invention where the multi-coordinate award wheel includes a terminator.

Referring to FIG. 6, another embodiment of the present invention includes one or more terminators 122, where the terminator is represented by the letter "X." If a player obtains a section associated with a terminator, the bonus game ends regardless of how many spins remain in the game. In this embodiment, the player attempts to obtain as many awards as possible before obtaining a terminator or running out of spins. It should be appreciated that a section including a terminator may be associated with a probability such that the coordinates of that section are more likely to be selected by the gaming device than the coordinates of a section associated with an award.

Because there are several different sections 104 including a plurality of awards 106 and one terminator 122, the coordinates are preferably associated with probabilities or weighted such that one coordinate is more likely to be indicated by the processor or indicator than another coordinate. In one embodiment, the coordinates are equally weighted or associated with equal probabilities. For example, if an award wheel has twenty-one sections, there are forty-two coordinates associated with those sections. A player, therefore, has a 1/42 or approximately 2.38% chance of obtaining any one of the coordinates. Therefore in this embodiment, a player's chances of obtaining the coordinates associated with a particular award are equal to their chances of obtaining the coordinates of the terminator.

In another embodiment, the probabilities change after each spin of the award wheel. Coordinates on the award wheel start a bonus game having predetermined probabilities and then the probabilities change after each spin by a player. For example, assume that at the beginning of a bonus game the player has a 2.38% chance of obtaining any coordinate on an award wheel having twenty-one sections. After the player's first spin, the player receives an award. Now the processor alters the probabilities so that the player has a 5% chance of obtaining each coordinate associated with the terminator and a 2.25% chance of obtaining a coordinate associated with any other section on the wheel. Thereafter, the probabilities continue to change after each subsequent spin by the player. It should appreciated that the probability of obtaining the coordinates associated with the terminator may decrease and the probabilities of obtaining the coordinates associated with the awards may increase after a spin, or the awards and terminator may alternately increase and decrease after each spin or change according to whatever probability scheme is desired by the game implementor. It should also be appreciated that the coordinate probabilities may change after the first spin only and remain the same the rest of the bonus game or change after any number of spins desired.

In another embodiment, the coordinate probabilities change after a predetermined number of spins of the award wheel. In this embodiment, the implementor sets the probabilities to change after a certain number of spins so that a coordinate having a terminator is more likely or a coordinate associated with a section having a large award is less likely the further the player goes into a bonus game. By adjusting the coordinate probabilities in this manner, the game implementor limits the award amounts that the gaming device pays to players. It also limits the likelihood that a player will obtain the one substantially large award on a spin of the award wheel.

For example, assume that an award wheel has twenty sections and a player starts the bonus game with a 2.5% probability of obtaining each coordinate on the wheel. Before the fourth spin of the award wheel, the coordinate probabilities are programmed to change so that there is a 10% chance of obtaining each coordinate associated with the terminator and approximately a 2.11% chance of obtaining each coordinate associated with a section. Now the player is more likely to obtain a terminator with each subsequent spin than any single award associated with a section.

Similarly, a bonus game could be programmed to decrease the probability of obtaining coordinates associated with a large award section after a certain number of spins. Therefore, a player still has the possibility of obtaining the large award, but the probability is less. For example, an award wheel having twenty-one sections, including one terminator and one large award section, starts a bonus game where a player has an equal probability of approximately 2.38% of obtaining each coordinate on the award wheel. The gaming device is programmed to decrease the probability of obtaining each coordinate of the large award section after five spins to 0.25%. Therefore after five successful spins of the award wheel, the probability of obtaining each coordinate of the large award section decreases to 0.25% and the probabilities of obtaining any one of the other coordinates associated with the other sections increases to 2.49%.

In a further embodiment, total awards or award payouts in a bonus game are associated with probabilities. In this embodiment, the processor of the gaming device is programmed so that relatively larger awards are less likely than relatively smaller awards, or vice versa, in a bonus game. Therefore the game implementor controls the award amounts that are paid out by the gaming device without affecting the player's excitement and enjoyment of playing the game. For example, a processor is programmed to award values of zero through fifty in 60% of the bonus games, 51 through 100 in 30% of the bonus games and over 100 in only 10% of the bonus games in a particular gaming device. Based on the probabilities, the processor picks a total award value for the bonus game and subsequently determines the number of spins and the award amounts for each spin for the game. Thus, the total award is predetermined before the game ever starts, yet the player plays the bonus game as if the award is still to be determined.

In yet another embodiment, each section is associated with a probability such that one section is more likely to be indicated than another section on the award wheel. For example, sections including large value awards have a lower probability of being indicated by the indicator than sections including relatively lower valued awards.

In each of the above embodiments, the players always have an opportunity or chance to obtain each section on the award wheel whether the section includes a terminator or an award. Therefore, although the section probabilities may change in a bonus game, the players maintain their excitement and enjoyment of the bonus game.

Figure 7:
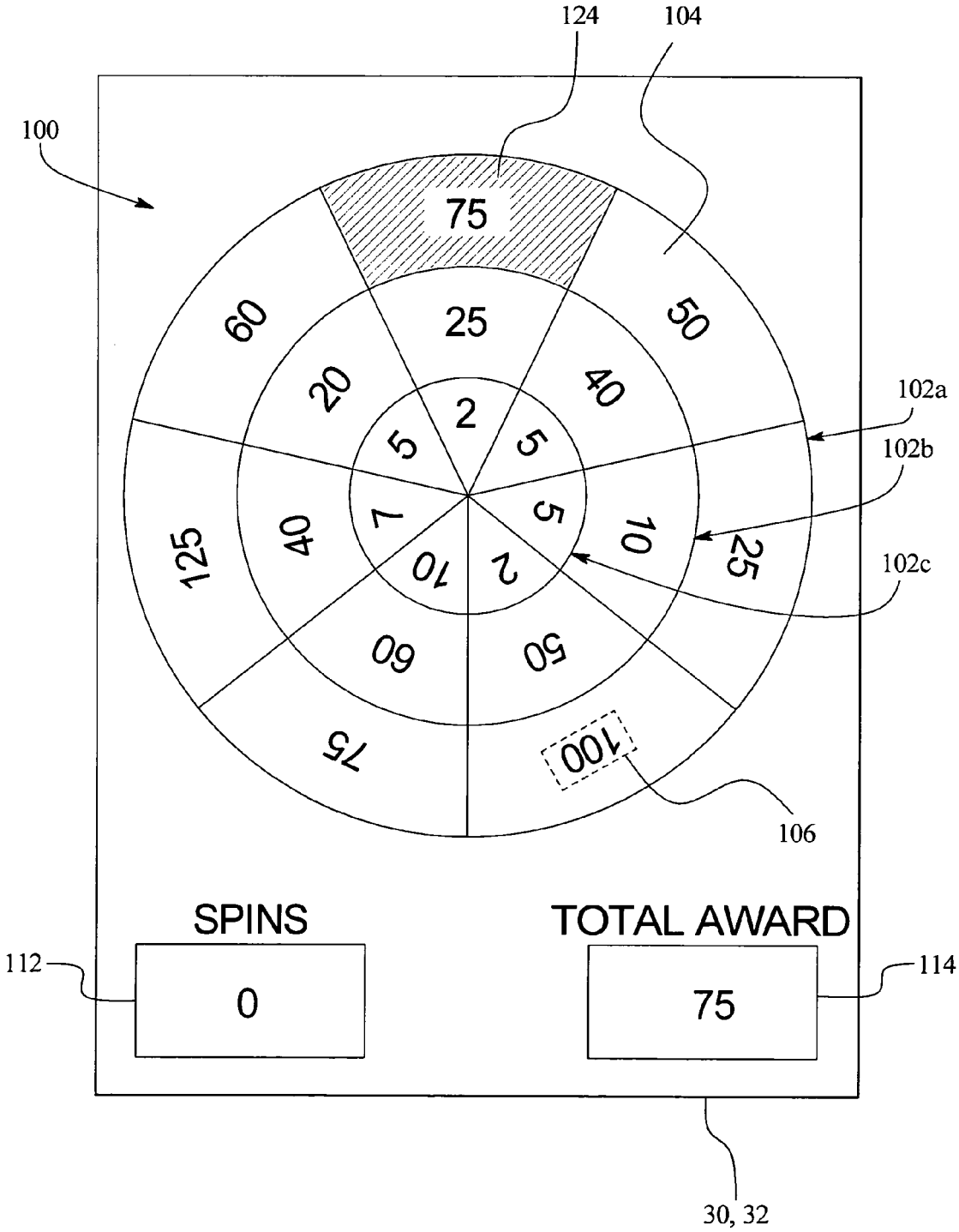
FIG. 7 is an enlarged elevation view of a further embodiment of the present invention where the multi-coordinate award wheel is stationary and the sections alternately illuminate to provide an award to the player.

Referring now to FIG. 7, a further embodiment of the present invention where the annular areas 102 are alternately illuminated until an area is selected by the gaming device.

Then the sections 104 within the selected annular area 102 are alternately illuminated until a section is selected. For example, the annular area 102*a* was selected by the gaming device. Then the gaming device selected section 124 within annular area 102*a* as the section provided to the player. The player receives an award of seventy-five associated with section 124.

Figure 8:
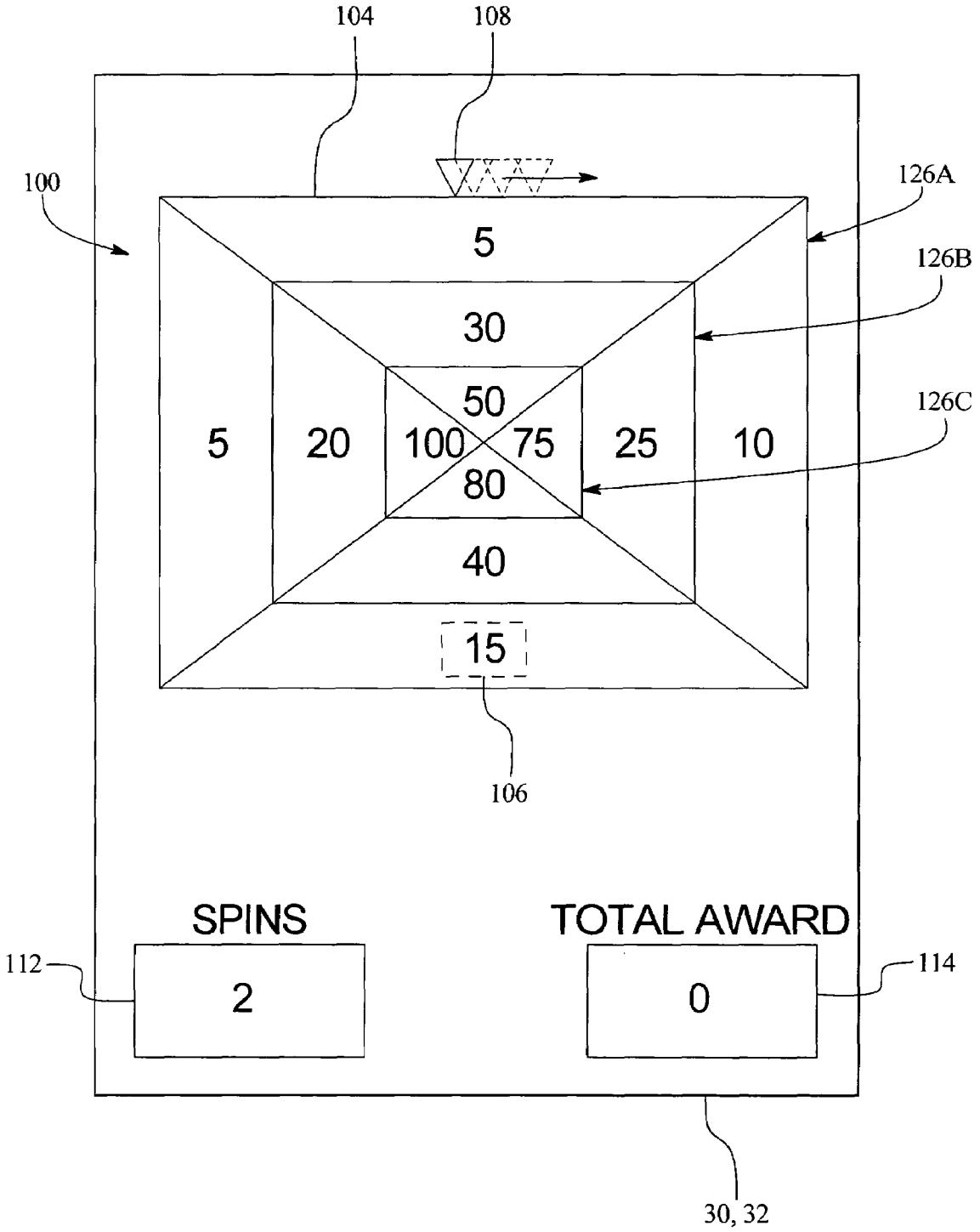
FIG. 8 is an enlarged elevation view of a further embodiment of the present invention where the sections are arranged in a square configuration.

Referring now to FIG. 8, another embodiment of the present invention is illustrated where the multi-coordinate award wheel 100 is a square. The award wheel 100 may be any shape or configuration as desired by the game implementor. In FIG. 8, the award wheel 100 includes square areas 126*a*, 126*b* and 126*c*. Each area is further divided into sections 104 that include awards 106. The sections each have an X coordinate and a Y-coordinate. An X,Y coordinate defines each of the sections displayed to the player. In operation, the gaming device alternately illuminates square areas 126*a* to 126*c* one at a time. The gaming device then picks one of the areas. Once an area 102 is picked, the section indicator 108 moves along the perimeter of the outside square 102*a* until a section is indicated. When the section indicator stops, a section 104 within the illuminated area 126 is determined. The award associated with this section is provided to the player and displayed in the total award display 114. The player continues to play the bonus game until the player runs out of spins in the bonus game.

In another embodiment of the present invention is illustrated where the award wheel sections 104 include an annular area 102 that has several low value awards, an annular area that has medium value awards and an annular area that has several high value awards. The probability of obtaining each low value award is preferably greater than the probability of obtaining the high value awards or the terminator. The award disparity creates enhanced levels of excitement for players because the player may obtain the large award. Additionally, the player is likely to obtain multiple spins in the bonus game because the probability of obtaining a low value award is higher than obtaining the terminator. Thus, each additional spin increases the player's excitement and enjoyment of the game because each spin means an additional opportunity to obtain the large award. Even if the player does not obtain the large award, the player still obtains several awards in the bonus game and may accumulate a large award before obtaining a terminator.

It should be appreciated that the terminator symbol could be a blank symbol and that one or more blank symbols could function as terminator symbol or can have no function or other functions. For instance, the occurrence of one or more blank symbols could provide alternative awards.

Figure 9:
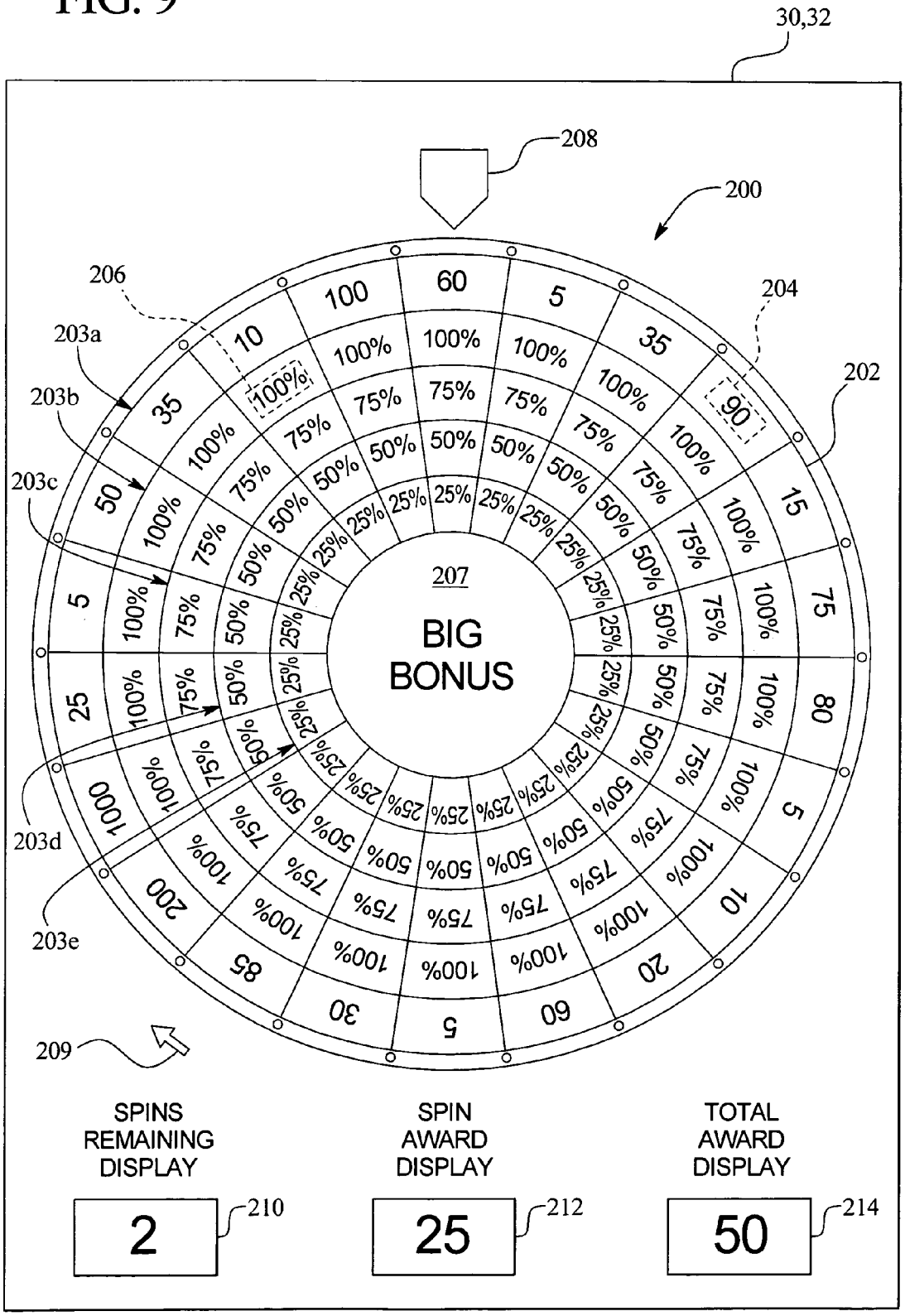
FIG. 9 is an enlarged elevation view of an alternative embodiment of the present invention where the sections of the wheel include awards and percentages of those awards.

Referring now to FIG. 9, an alternative embodiment of the present invention is illustrated where the sections 204 on the award wheel 200 include a plurality of awards and a plurality of award percentages. Specifically, the award wheel 200 includes a plurality of sections 202, wherein the sections are arranged in a plurality of groups. The groups of sections include a symbol group, which includes the sections in annular area 203*a*, and a plurality of modifier groups, which include the sections in annular areas 203*b*, 203*c*, 203*d* and 203*e*. It should be appreciated that although the groups in this embodiment include the sections in the annular areas on the award wheel 200, the groups may include any suitable number of sections or arrangement of sections.

In one embodiment, a plurality of awards, such as award values or credits, are associated with the sections in the symbol group or annular area 203*a*. The awards may include values, multipliers, modifiers, monetary prizes, non-monetary prizes, physical prizes or any suitable type of award. It should also be appreciated that any of the annular areas or groups on the award wheel 200 may include sections having one or more awards.

A plurality of award portions or award percentages 206 are associated with the sections in the modifier groups or annular areas 203*b*, 203*c*, 203*d* and 203*e*. In this embodiment, modifier group or annular area 203*b* includes award percentages of 100% associated with each of the sections in this group. Modifier group or annular area 203*c* includes award percentages of 75% associated with each of the sections in the group. Modifier group or annular area 203*d* includes award percentages of 50% associated with each of the sections in the group. Additionally, modifier group or annular area 203*e* includes award percentages of 25% associated with each of the sections in this group. It should be appreciated that the award percentages may be any suitable award percentage desired by the game implementor. In one embodiment, as shown in FIG. 9, the award percentages associated with the sections in each of the modifier groups are the same. In another embodiment, the award percentages associated with the sections in each of the modifier groups are different. It should be appreciated that at least one of the award percentages, a plurality of the award percentages or all of the award percentages associated with the sections within each of the groups may be different. Additionally, the award percentages associated with the sections may be different from group to group. For example, as shown in FIG. 9, the award percentages associated with modifier group 203*e* are less than the award percentages associated with modifier group 203*d*. Similarly, the award percentages associated with modifier groups 203*c* and 203*b* incrementally increase. It should be appreciated that the award percentages associated with the sections in the groups may increase from the innermost annular area or modifier group 203*e* to the outermost annular area or group 203*b*. The award percentages may also decrease from modifier group or annular area 203*e* to modifier group or annular area 203*b*. It should be appreciated that any suitable award percentages may be associated with the sections in each of the modifier groups. Furthermore, the award percentages in FIG. 9 are shown as percentages or percentage values. However, the award percentages may be represented as fractions, decimals or any other suitable type of award portion, fraction or percentage.

As will be explained below, the gaming device indicates an award percentage and an award in each activation or spin of the award wheel 200. The indicated award percentage is multiplied by the or applied to an indicated award in the symbol group to provide an activation or spin award to the player for that activation or spin. For example, when an indicated section includes an award percentage of 25% (0.25), the gaming device provides the player with 25% of the award associated with the indicated section in the symbol group. In other words, the gaming device multiplies the indicated award by 0.25 to provide an activation award to the player for that activation or spin. Similarly, the gaming device provides 50%, 75%, and 100% of the indicated awards when each of those award percentages are indicated on the award wheel.

In one embodiment, each of the modifier groups or annular areas 203*a*, 203*b*, 203*c*, 203*d* and 203*e* are included on the same wheel and rotate in the same direction. In another embodiment, at least one of the modifier groups or annular areas 203 is included on a separate wheel from the other annular areas. In this embodiment, the wheels may rotate in the same direction or in different directions. In a further embodiment, each of the modifier groups or annular areas 203 are included on separate wheels. The wheels may rotate in the same direction, at least one may rotate in different directions from the other wheels or a plurality of the wheels may rotate in a different direction. It should be appreciated that the modifier groups 203 may be included on the same or different wheels and rotate in any suitable direction desired by the game implementor. It should also be appreciated that the award wheel 200 may be stationary and the section indicator 208 may rotate about the perimeter of the award wheel in a clockwise or counterclockwise direction.

The gaming device also includes a bonus award such as a big bonus award 207. In one embodiment, the gaming device provides a player with the big bonus award 207 when the player accumulates all of the sections associated with an award (i.e., each of the sections associated with an award are indicated or illuminated in the game). It should be appreciated that the big bonus award may be provided to the player based on any suitable number of indicated sections in the game, or other combinations of indicated sections in the game. The big bonus award 207 indicated in the middle of the award wheel 200 includes a masked or hidden award that is provided to the player by the gaming device when all of the award percentages associated with a particular award indicated in the game (i.e, in the number of spins of the wheel provided to the player). It should be appreciated that the big bonus award may be provided to the player when a designated number of sections in an annular area, a plurality of annular areas, a pie-shaped section, a plurality pie shaped sections, or any other suitable section or area on the wheel are indicated in a game. The big bonus award may be an award value, a modifier, a multiplier, free spins, free games or any other suitable award. The big bonus award 207 is provided to the player in the game or in a subsequent game (i.e, free spins) or added to the player's total award in the game (i.e, an award value or credits). It should be appreciated that the big bonus award 207 may be masked or displayed to the player in the game.

Additionally, a spins remaining display 210 indicates the number of spins remaining in the game. A spin award display 212 (or activation award display) and a total award display 214 indicate the award associated with a particular activation or spin in the game and the total accumulated award provided to the player in the game, respectively.

Referring to FIGS. 10A to 10M, an example of the embodiment of FIG. 9 is illustrated where the gaming device provides a player with six activations or spins at the beginning of the game. Also, the player's total award is zero as indicated by the total award display 214. In this example, the award wheel 200 includes a plurality of sections 202. The sections are included in a plurality of groups on the wheel. The groups include a symbol group or annular area 203*a* and a plurality of modifier groups or annular areas 203*b*, 203*c*, 203*d* and 203*e*. A plurality of awards 204 are associated with the sections of the symbol group 203*a* and a plurality of award percentages 206 are associated with the sections in modifier groups 203*b*, 203*c*, 203*d*, and 203*e*. It should be appreciated that the sections in the modifier groups 203*b*, 203*c*, 203*d* and 203*e* may also include fixed amounts such as fixed awards which increase in value from annular area 203*e* to annular area 203*a*, decrease in value from annular area 203*e* to annular area 203*a* or include any suitable fixed amounts or awards. In this example, the award wheel is a single award wheel including all of the groups of sections or annular areas 203. The wheel rotates or spins in a clockwise direction as indicated by the arrow 209.

Figure 10A:
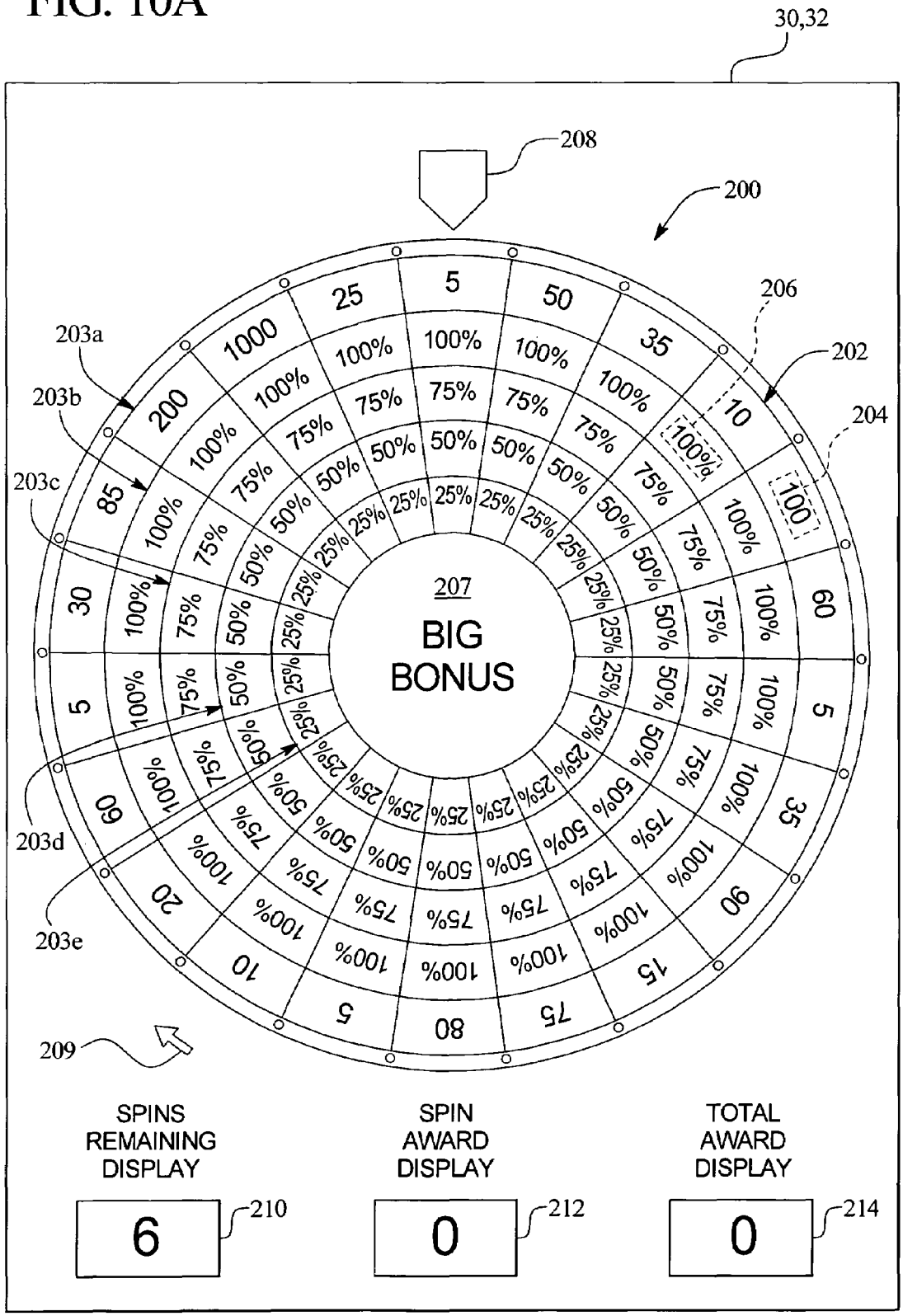
FIGS. 10A, 10B, 10C, 10D, 10E, 10F, 10G, 10H, 10I, 10J, 10K, 10L, and 10M are enlarged elevation views of an example of the alternative embodiment of FIG. 9.
Figure 10B:
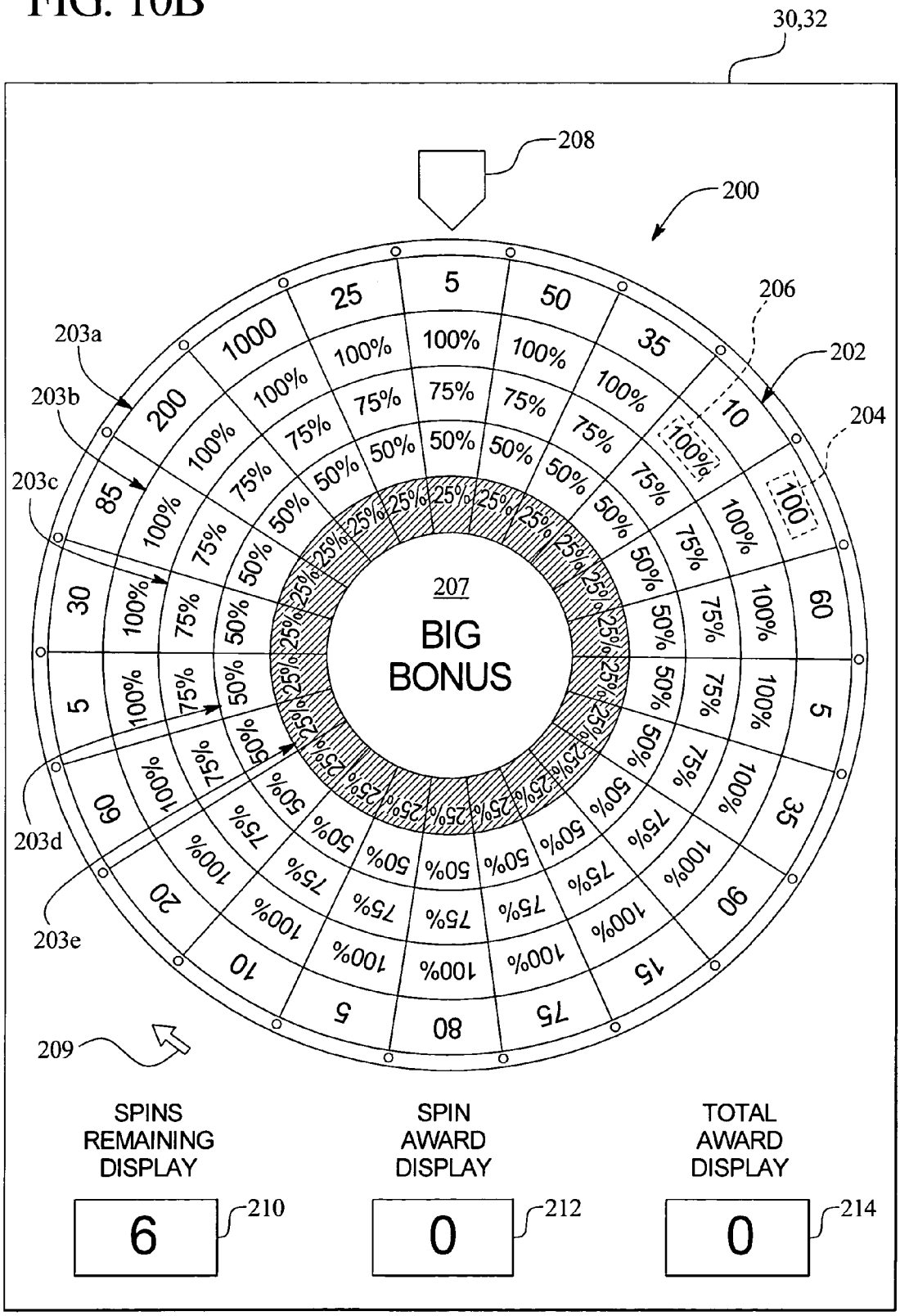

Referring to FIG. 10B initially, the gaming device and processor alternately illuminate each of the groups of sections or annular areas 203 on the award wheel 200. For example, all of the sections and symbol group 203*a* are highlighted or illuminated and then all the sections in modifier group 203*b* are highlighted or illuminated and each subsequent group is then highlighted or illuminated. The indicated modifier group remains highlighted or illuminated until the section indicator 208 indicates one of the sections in that group. This illumination pattern repeats until the processor picks one or stops on one of the groups or annular areas. It should be appreciated that the groups or annular areas 203 may be highlighted or illuminated in any order or sequence. It should also be appreciated that one or more of the groups or annular areas 203 may be simultaneously highlighted or illuminated during the game. Additionally, it should be appreciated that the gaming device may not include a section indicator 208 and therefore indicates the sections on the wheel by illuminating an annular area and then subsequently illuminating a section in the indicated annular area. The sections may also be indicated by raising or lowering the indicated sections on the wheel such as on a mechanical wheel. The raising and lowering of the sections to indicate the sections on the wheel may also be accomplished in a video-type wheel where a three dimensional virtual wheel is displayed to the player. On a video wheel, the individual sections would rise or move upwards to indicate the indicated section on the wheel in a spin. It should be appreciated that one section, a plurality of the sections or all the sections may raise and/or lower simultaneously or alternately in a spin or plurality of spins in a game. As described above, the present invention may employ a mechanical or electrical mechanical wheel, an electronic wheel or a video wheel displayed on a display device.

In FIG. 10B, the gaming device alternately illuminates the modifier groups on the award wheel 200 until stopping on modifier group 203*e*. Award percentages of 25% are associated with each of the sections in the indicated modifier group 203*e*. After the group is indicated, the gaming device or player activates or spins the award wheel 200 in a clockwise direction as shown by arrow 209 to indicate one of the sections in the highlighted or indicated modifier group 203*e*. In this example, the gaming device spins the award wheel 200 and the section indicator 208 indicates one of the sections in the modifier group and also one of the sections in the symbol group. The award associated with the indicated section in the symbol group 203*a* is modified by or multiplied by the award percentage associated with the indicated section in the indicated modifier group. Referring to FIG. 1C, the section indicator 208 indicates one of the sections in the symbol group 203*a* having an associated award of one hundred and a section in the modifier group 203*a* having an award percentage of 25%. Thus, the award of one hundred is multiplied by the indicated award percentage 25% to give a multiplied award of twenty-five. The multiplied award is the activation award or spin award for that spin in the game. In this example, the spin award is twenty-five (100×0.25). Because the total award was zero at the beginning of the game, the player's new total award is twenty-five, as indicated by the total award display 214. The player now has five spins remaining as indicated by the spins remaining display 210.

In this example, the award percentage associated with the indicated section on the award wheel remains highlighted or indicated in the subsequent spins in the game. This enables a player to accumulate the award percentages in the game and attempt to accumulate all of the award percentages associated with a particular award in the game. By keeping the indicated sections highlighted or illuminated in the game, the gaming device provides a visual indicator of how the player is progressing in the game and also how many more sections the player needs to obtain to achieve an additional award or big bonus award in the game. Thus, the player's enjoyment and excitement increases in the games. If the player accumulates all of the award percentages associated with a particular award, the gaming device provides the player with the big bonus award 207 as described above. In this example, the gaming device provides an additional award of five hundred for the big bonus award 207.

Figure 10C:
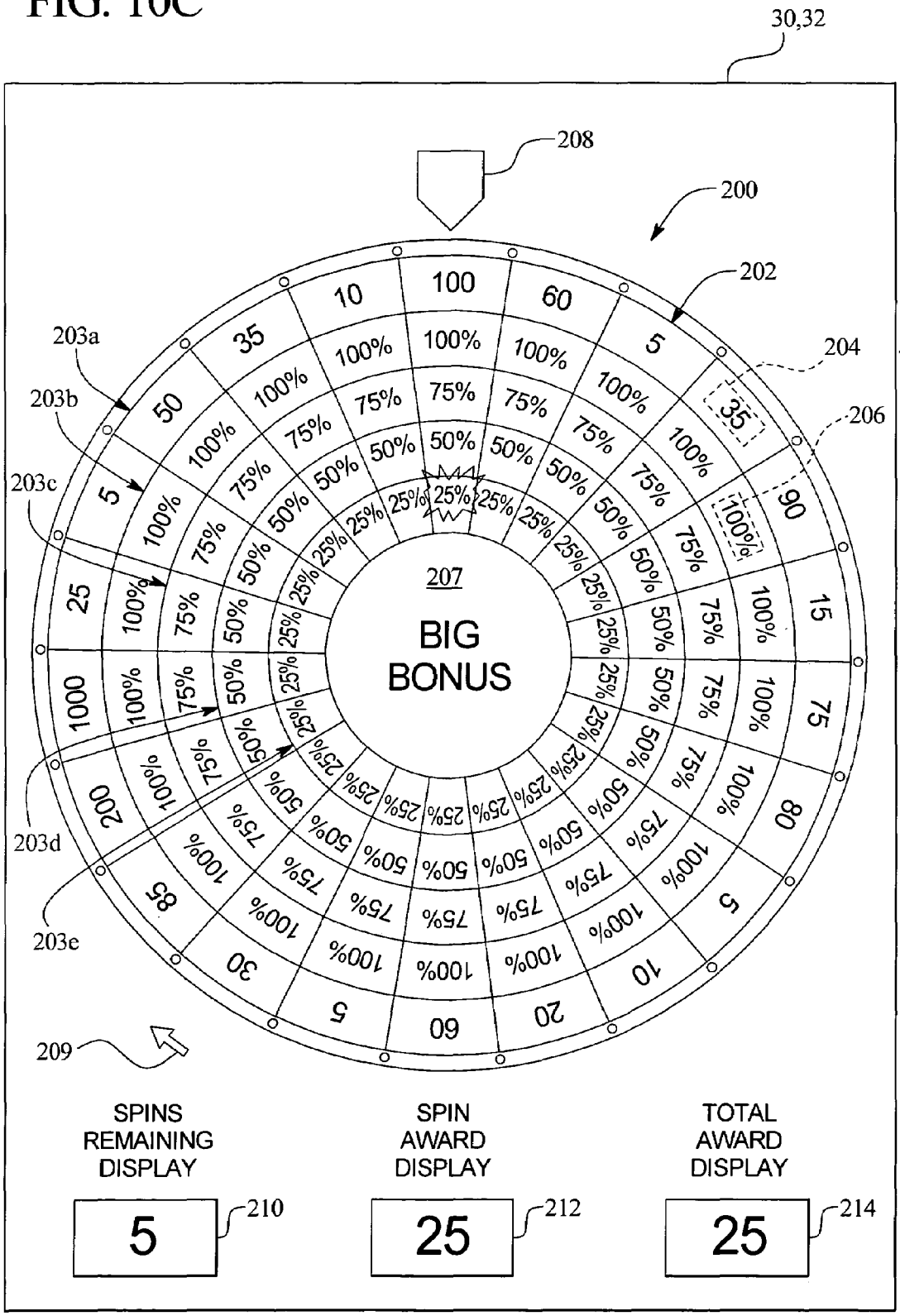
Figure 10D:
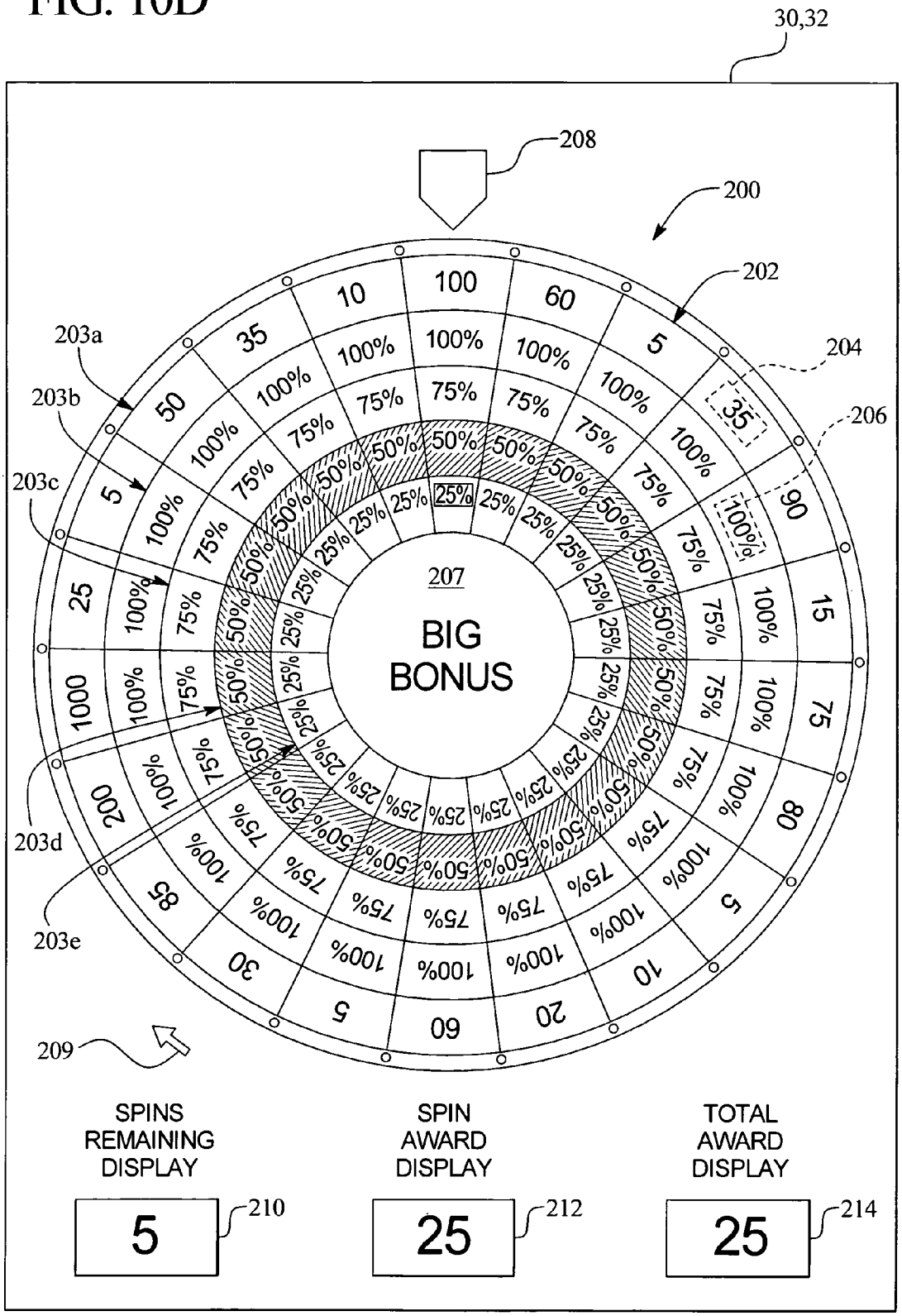

Referring to FIG. 10D, the gaming device alternately illuminates the modifier group or annular areas 203 and stops on modifier group 203*d*. The modifier group 203*d* remains highlighted as shown in FIG. 10C until the gaming device or player spins the wheel to indicate one of the sections in that group. Modifier group 203*d* includes sections having an award percentage of 50% (0.50). Therefore, any award associated with a section indicated by the section indicator 208 in the symbol group 203*a* will be multiplied by 50% or 0.50 to provide the player with a spin award for that spin. As shown in FIG. 10D, the award percentage associated with the indicated section remains highlighted as shown by the box or border around that award percentage.

Figure 10E:
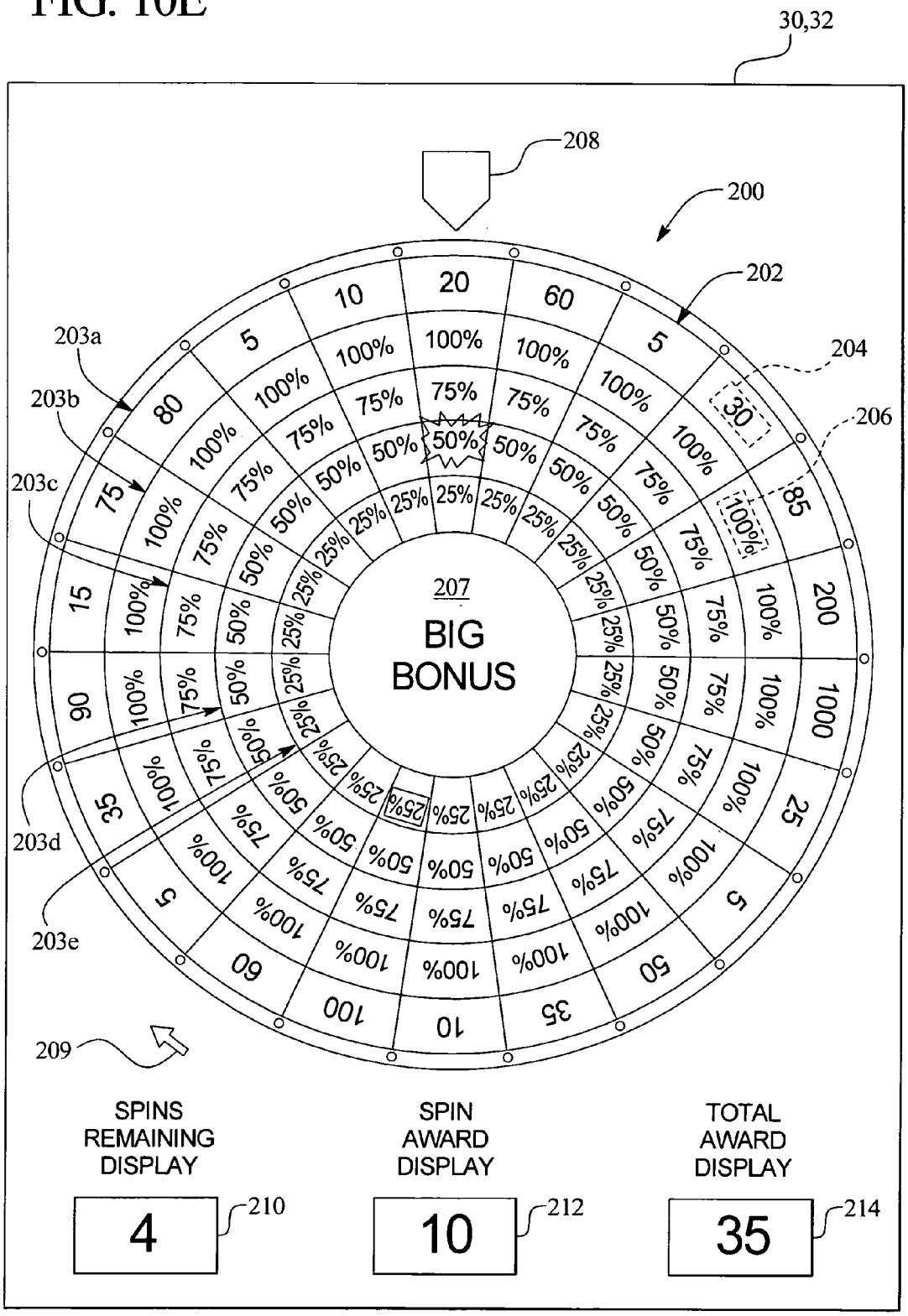

Referring to FIG. 10E, the gaming device spins the award wheel in a clockwise direction to determine the angular coordinate of a section included in the indicated modifier group or annular area 203*d*. In this example, the section indicator 208 indicates a section in the modifier group 203*d* including an award percentage of 50% and a section in the symbol group having an award of twenty. The gaming device therefore multiples the award of twenty by 50% or 0.50 to provide the player with a spin award of ten (20 times 0.50) for that spin as indicated by the spin award display 212. The award of ten is added to the player's previous total award of twenty-five to provide the player with a new total award of thirty-five as indicated by the total award display 214. The player now has four spins remaining in the game as indicated by the spins remaining display 210.

Figure 10F:
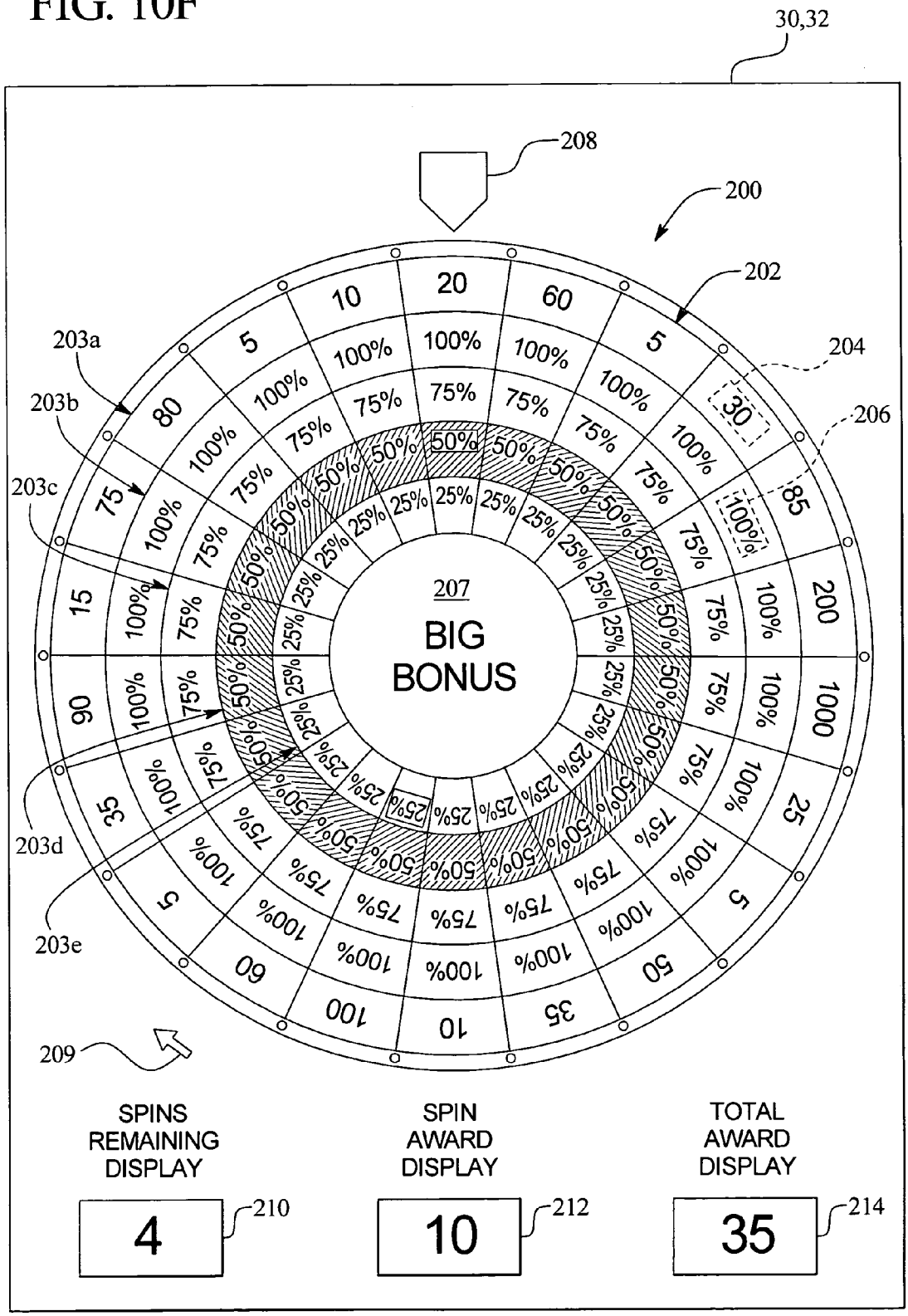
Figure 10G:
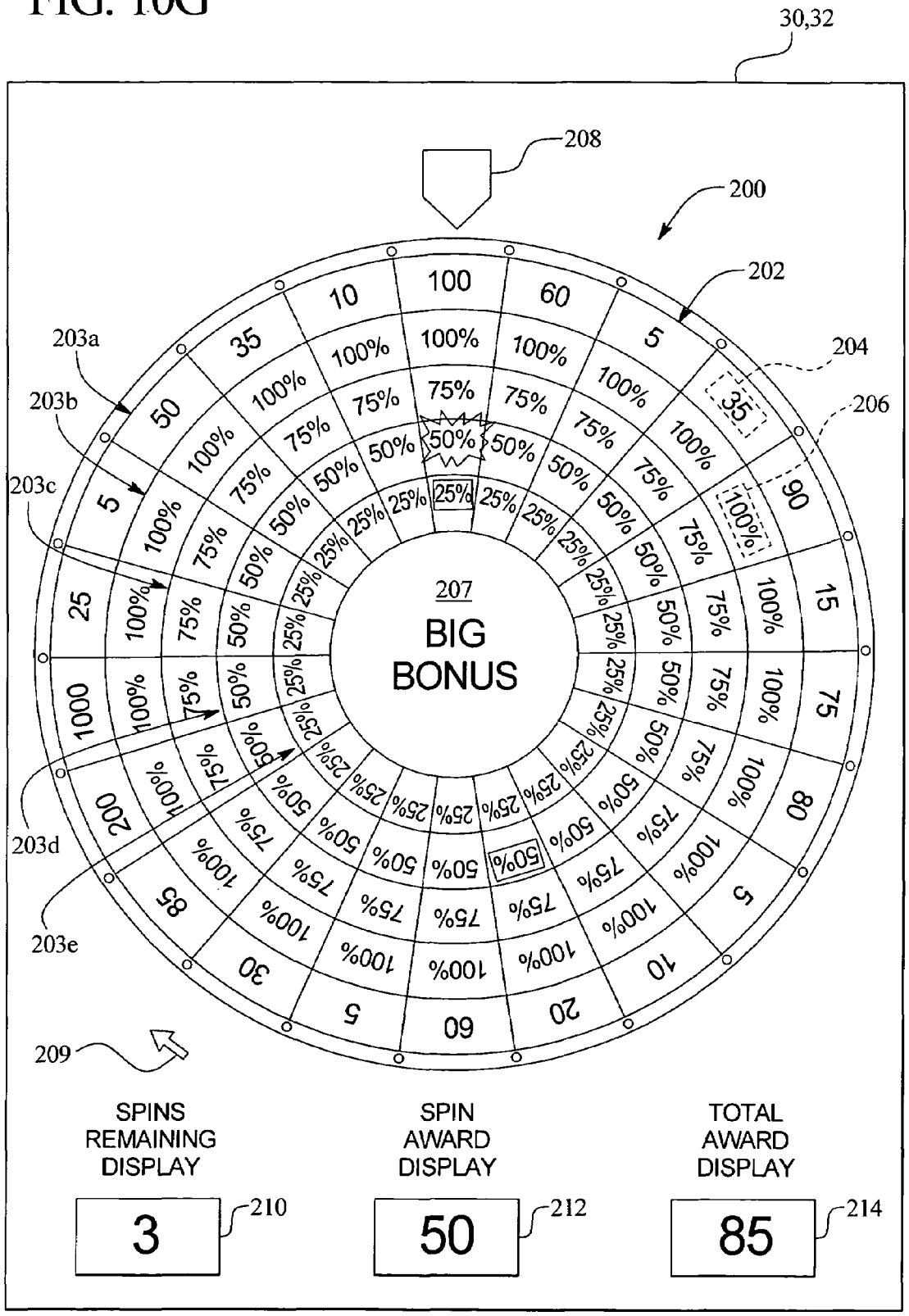

Referring to FIG. 10F, the gaming device alternately illuminates the modifier groups or annular areas 203 and stops on modifier group 203*d*. As in the previous spin, annular area 203*d* includes sections having award percentages of 50%. Thus, any award indicated by section indicator 208 will be multiplied by 50% or 0.50 to provide the player with a spin award in that spin. Referring to FIG. 10G, the gaming device spins the award wheel 200 and the section indicator 208 indicates a section in the symbol group or annular area 203*a* having an award of one hundred. This is the second time in the game that the award of one hundred has been indicated and therefore the player now has indicated two of the sections associated with the award of one hundred include the award percentages of 25% and 50%. If the two remaining sections associated with the award of one hundred, including the award percentages of 75% and 100%, are indicated by the section indicator 208 in this game, the player wins the big bonus 207. The gaming device provides the player with a spin award that equals 50% or 0.50 of the indicated award of one hundred. Therefore, the gaming device provides the player with a spin award of fifty (100×0.50) as indicated by the spin award display 212. The spin award of fifty is added to the player's total award of thirty-five to provide the player with a new total award of eighty-five as indicated by the total award display 214. The player now has three spins remaining in the game as indicated by the spins remaining display 210.

Figure 10H:
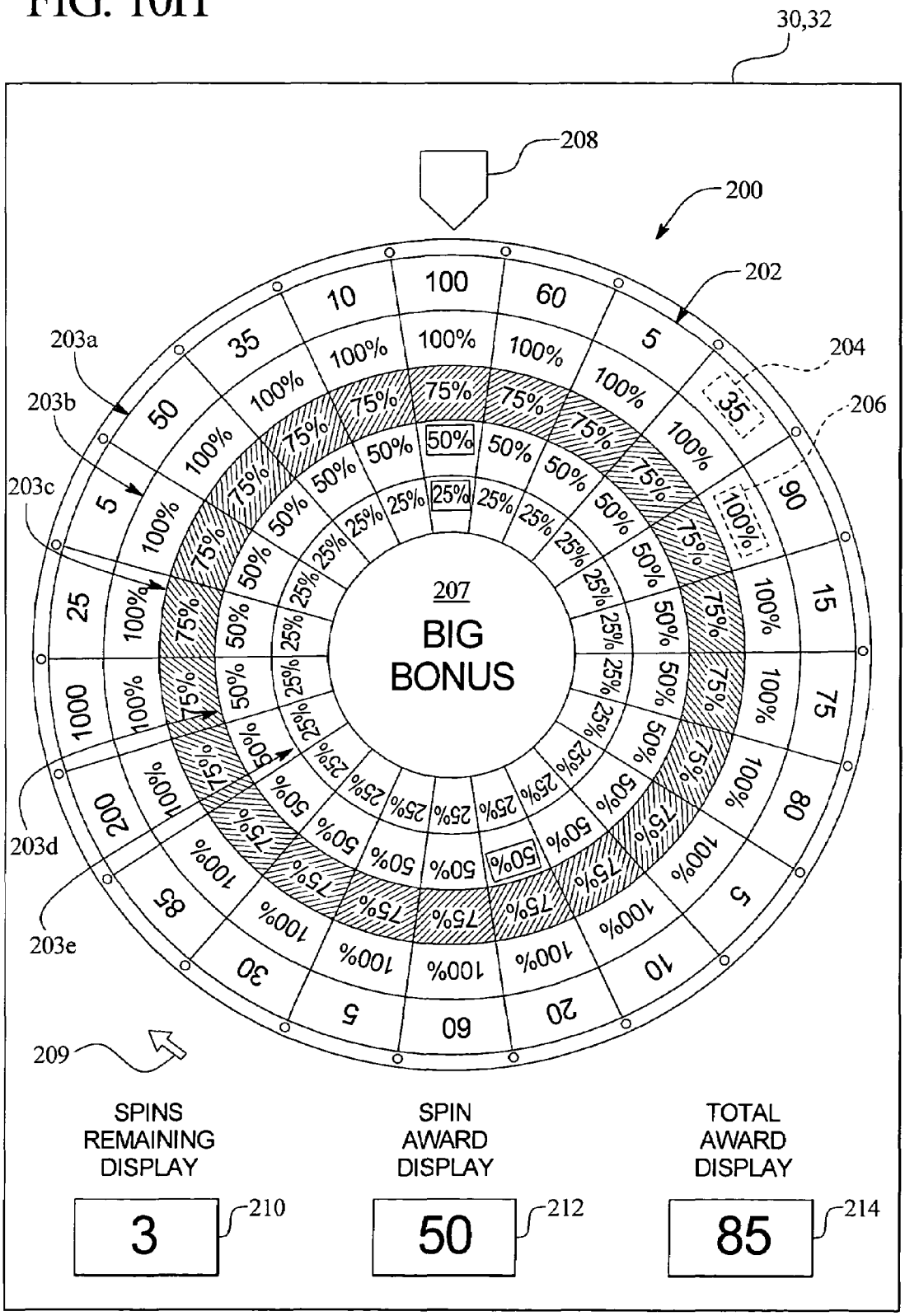
Figure 10I:
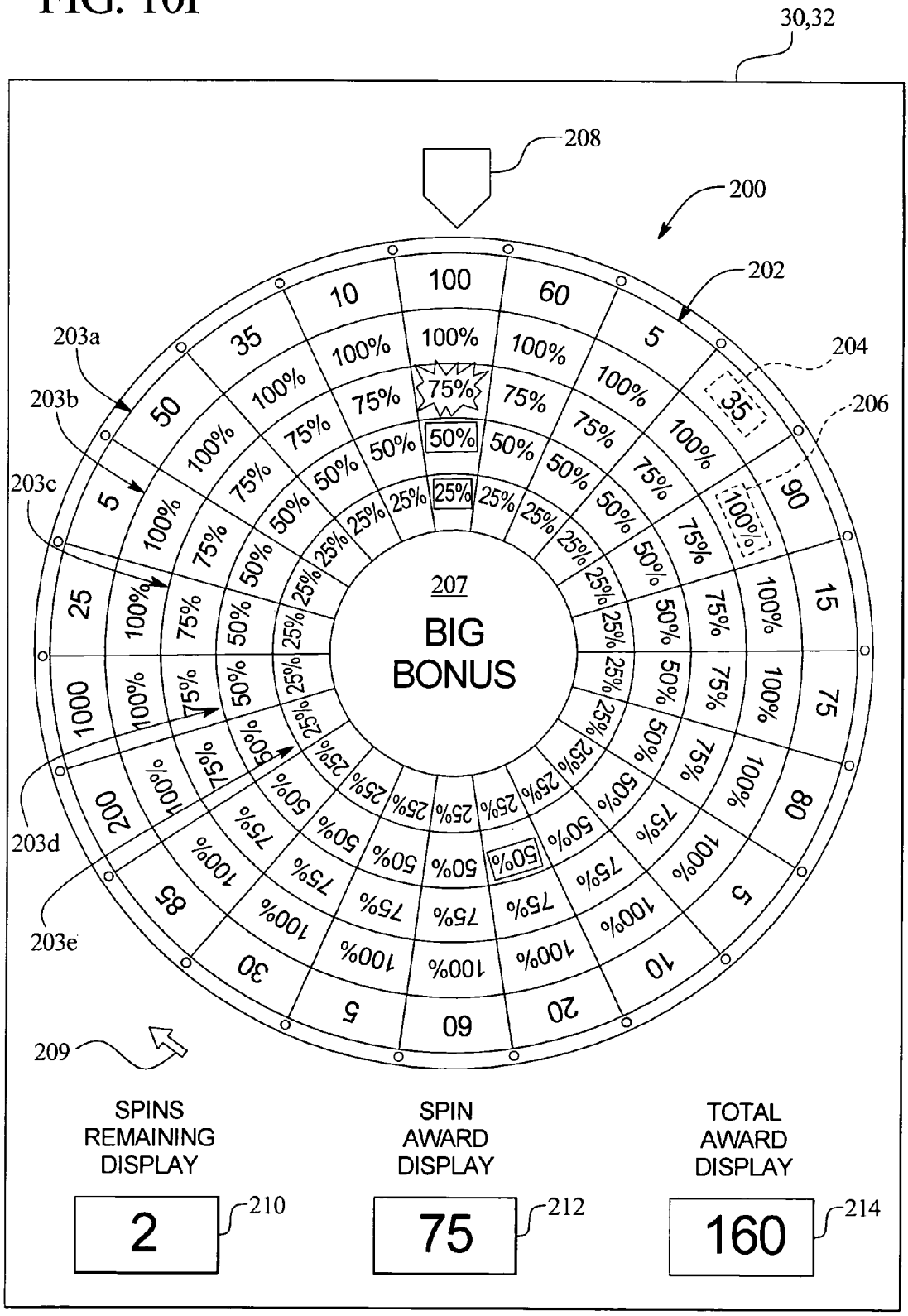

Referring to FIG. 10H, the gaming device alternatively illuminates the modifier groups or annular areas 203 and selects modifier group 203*c*. Modifier group or annular area 203*c* remains highlighted until the player spins the award wheel 200 to indicate a section in this group. Additionally, modifier group 203*c* includes sections having award percentages of 75%. Thus, any award indicated by the section indicator 208 will be multiplied by 75% to provide a spin award to the player for that spin. Referring to FIG. 10I, the gaming device spins the award wheel 200 and the section indicator 208 indicates a section including an award of one hundred. Thus, the gaming device provides the player with 75% (100×0.75) of the indicated award of one hundred or an award of seventy-five (100×0.75). The award of seventy-five (100×0.75) is indicated by the spin award display 212. In addition, the award of seventy-five (100×0.75) is added to the player's previous total award and the player now has a new total award of one hundred sixty as indicated by the total award display 214. The player now has two spins remaining in the game as indicated by the spins remaining display 210.

Figure 10J:
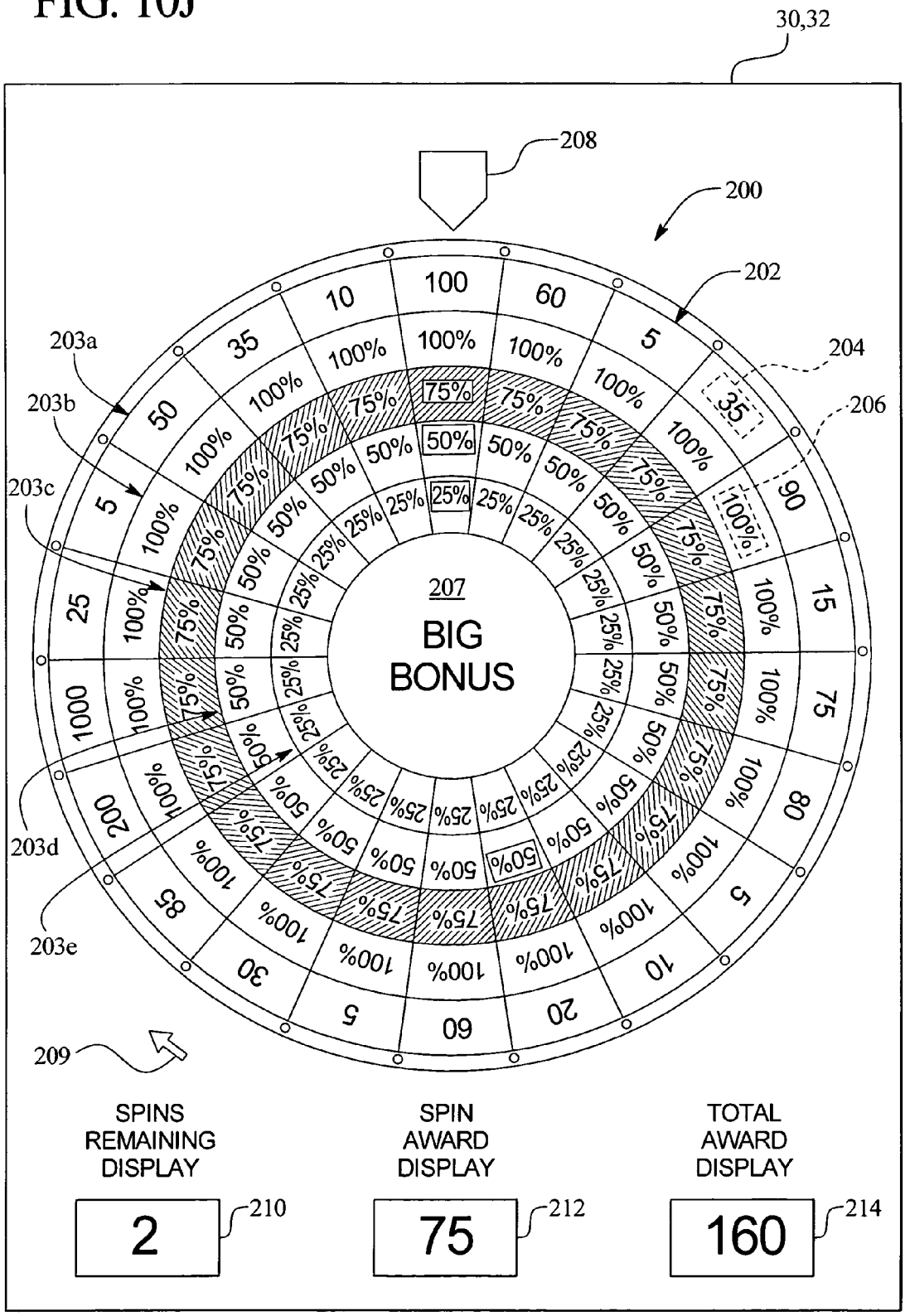
Figure 10K:
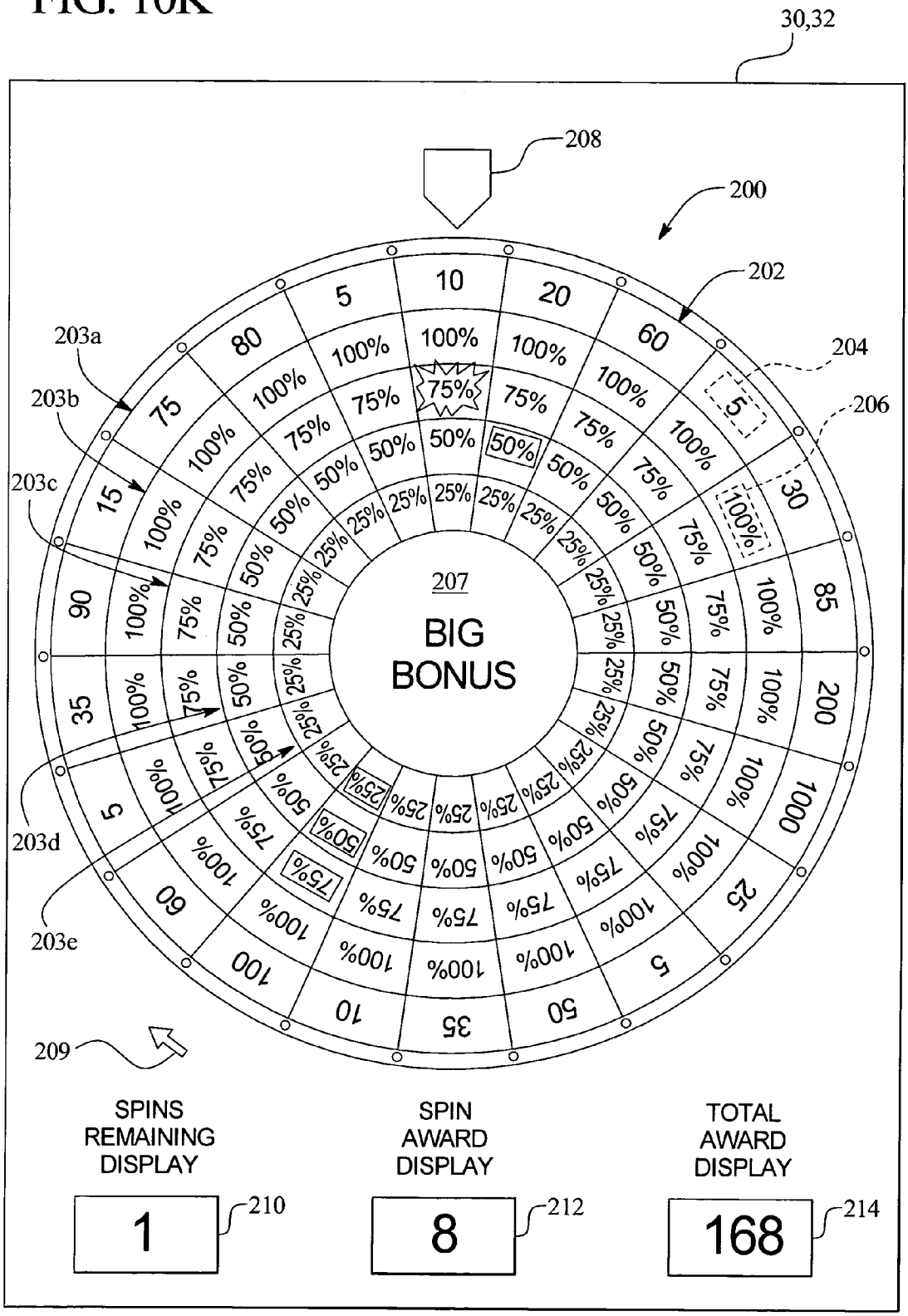

Referring to FIG. 10J, the gaming device alternatively illuminates the modifier groups 203 and selects group 203*c*. The sections included in the modifier group or annular area 203*c* include award percentages of 75%. The annular area 203*c* remains highlighted until the gaming device spins the award wheel 200 to indicate a section in this group. Referring to FIG. 10K, the gaming device spins the award wheel 200 and the section indicator 208 indicates a section in the symbol group 203*a* having an award of ten. Thus, the gaming device multiplies the award of ten by 75% to produce an award of seven and one-half (i.e., 7.5) for that spin. In this example, the gaming device only provides awards having whole numbers or integers and therefore does not provide the player with an award of seven and one-half (i.e., 7.5). Instead, the gaming device rounds the award of seven and one-half (i.e., 7.5) to an award of eight and provides that award to the player for this spin. It should be appreciated however, that the gaming device may round the number up, round the number down, provide the player with the decimal award or any suitable award desired by the game implementor. The spin award of eight is then indicated by the spin award display 212 and added to the player's previous total award of one hundred sixty. The player's new total award is one hundred sixty-eight, as indicated by the total award display 214. The player has one spin remaining in the game as indicated by the spins remaining display 210. As shown in FIGS. 10J and 10K, all the previously indicated sections in the modifier groups on the award wheel 200 remain highlighted or otherwise indicated to show that these awards were previously indicated in the game. This enables a player to track or see which modifiers or sections the player has obtained and which modifiers the player still needs to indicate to obtain the big bonus award 207 in the remaining spins in the game.

Figure 10L:
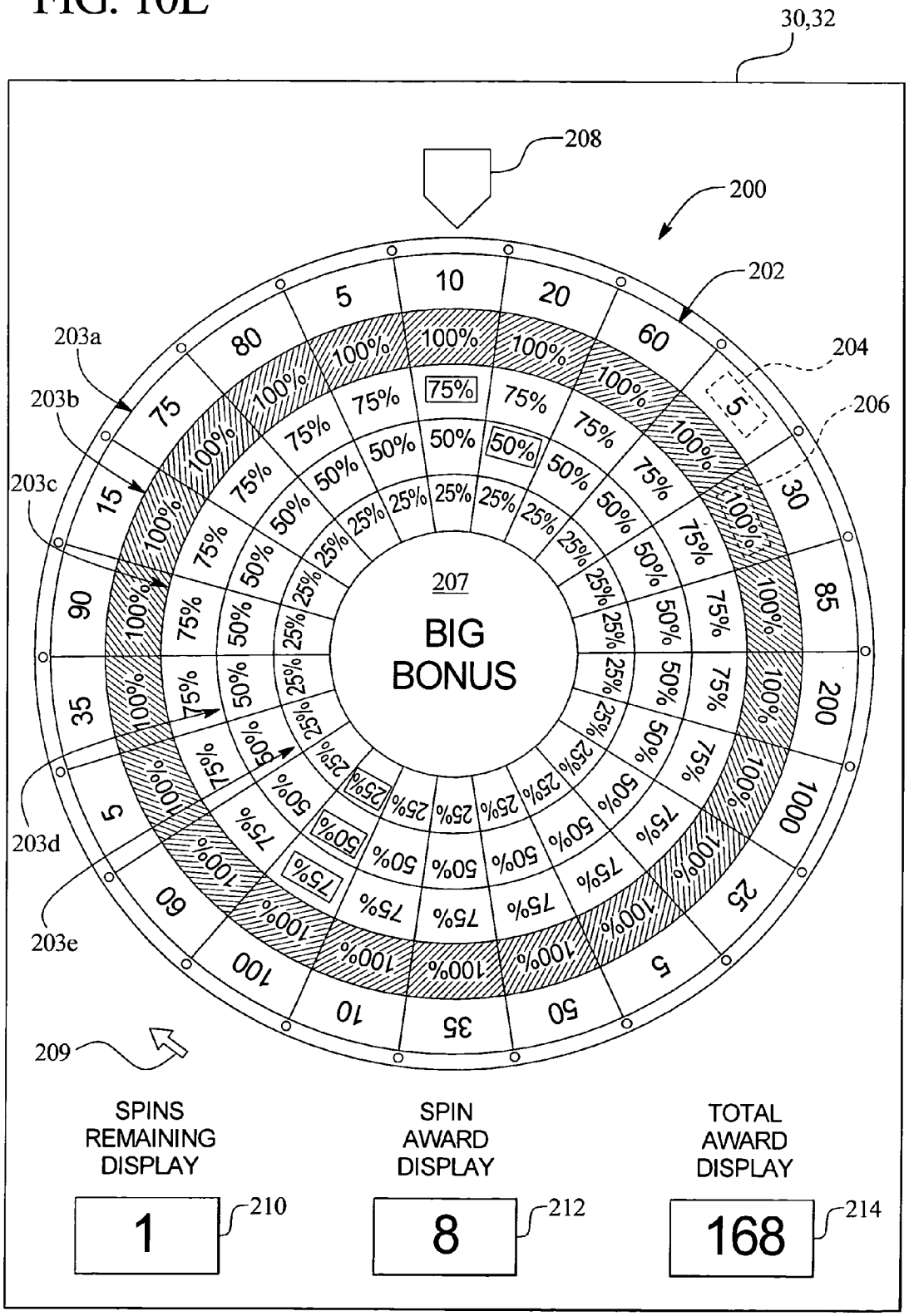
Figure 10M:
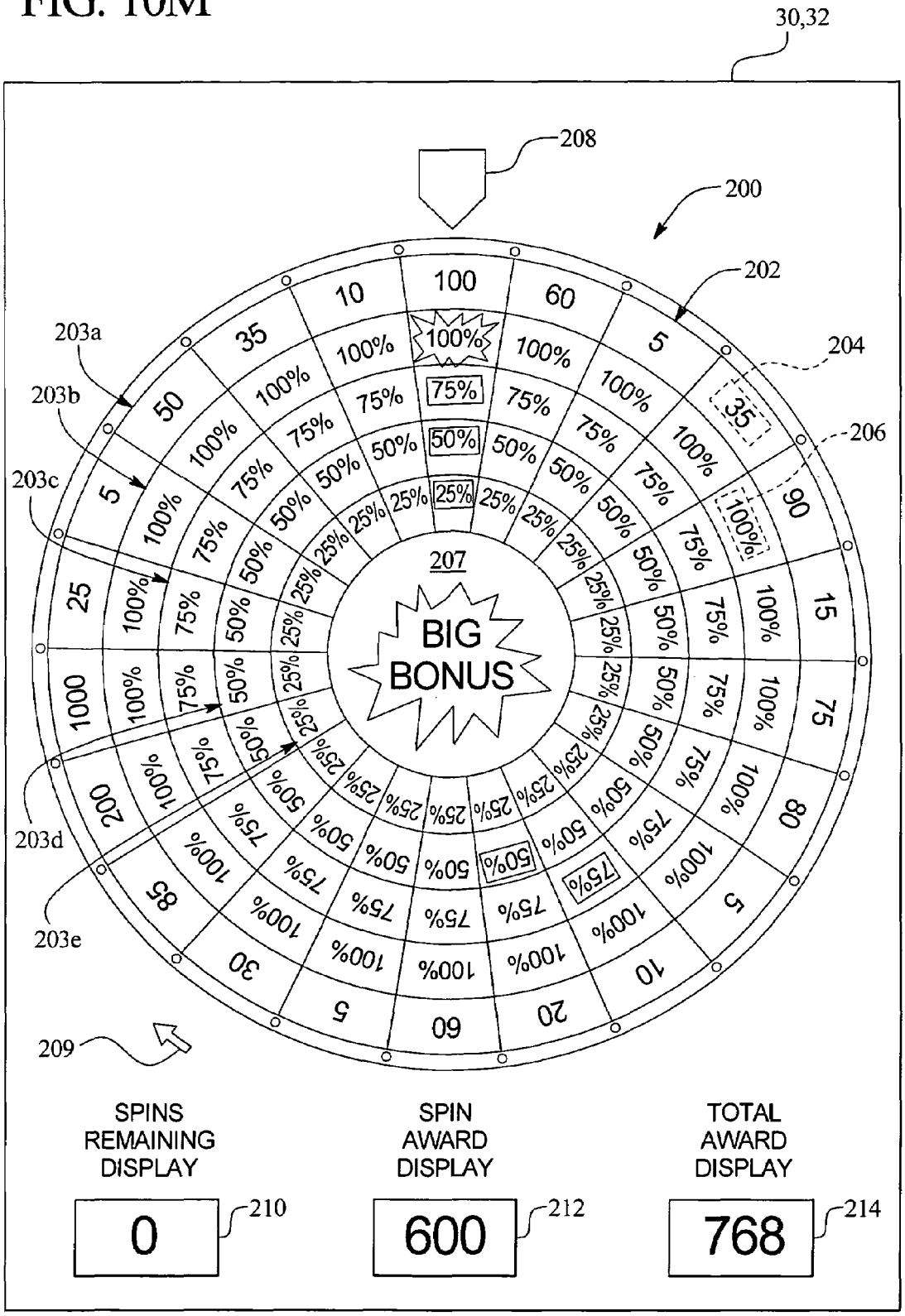

Referring to FIG. 10L, the gaming device alternately illuminates the modifier groups or annular areas 203 and stops on the modifier group 203*b*. Modifier group 203*b* includes sections having an award percentage of 100%. The gaming device will therefore multiply any awards indicated in the symbol group in this spin by 100% (i.e., provide the entire award to the player). Referring to FIG. 10M, the gaming device spins the award wheel and the section indicator 208 indicates a section in symbol group 203*a* including an award of one hundred. In this game, the sections including the award percentages of 25%, 50% and 75% have already been indicated by the section indicator 208 as shown by the boxes or borders surrounding the award percentages associated with those sections. In this spin, the fourth or final section including the award percentage of 100% is indicated by the section indicator in the game. The gaming device therefore provides 100% of the award of one hundred to the player or a spin award of one hundred.

Additionally, because the player indicated all of the sections in the symbol groups 203 associated with a single award (i.e., the award of one hundred), the gaming device provides the player with the big bonus award 207 as shown in FIG. 10M. In this example, the big bonus award 207 includes an award of five hundred as described above. The big bonus award of five hundred is added to the player's spin award of one hundred to provide the player with a total spin award of six hundred as indicated by the spin award display 212. The spin award of six hundred is then added to the player's previous total award of one hundred sixty-eight to provide the player with a new total award of seven hundred sixty-eight as indicated by the total award display 214. The player does not have any spins remaining as indicated by the spins remaining display 210 and therefore, the game ends. The gaming device provides the player with the total award of seven hundred sixty-eight indicated in the total award display 214 for the game.

Figure 11:
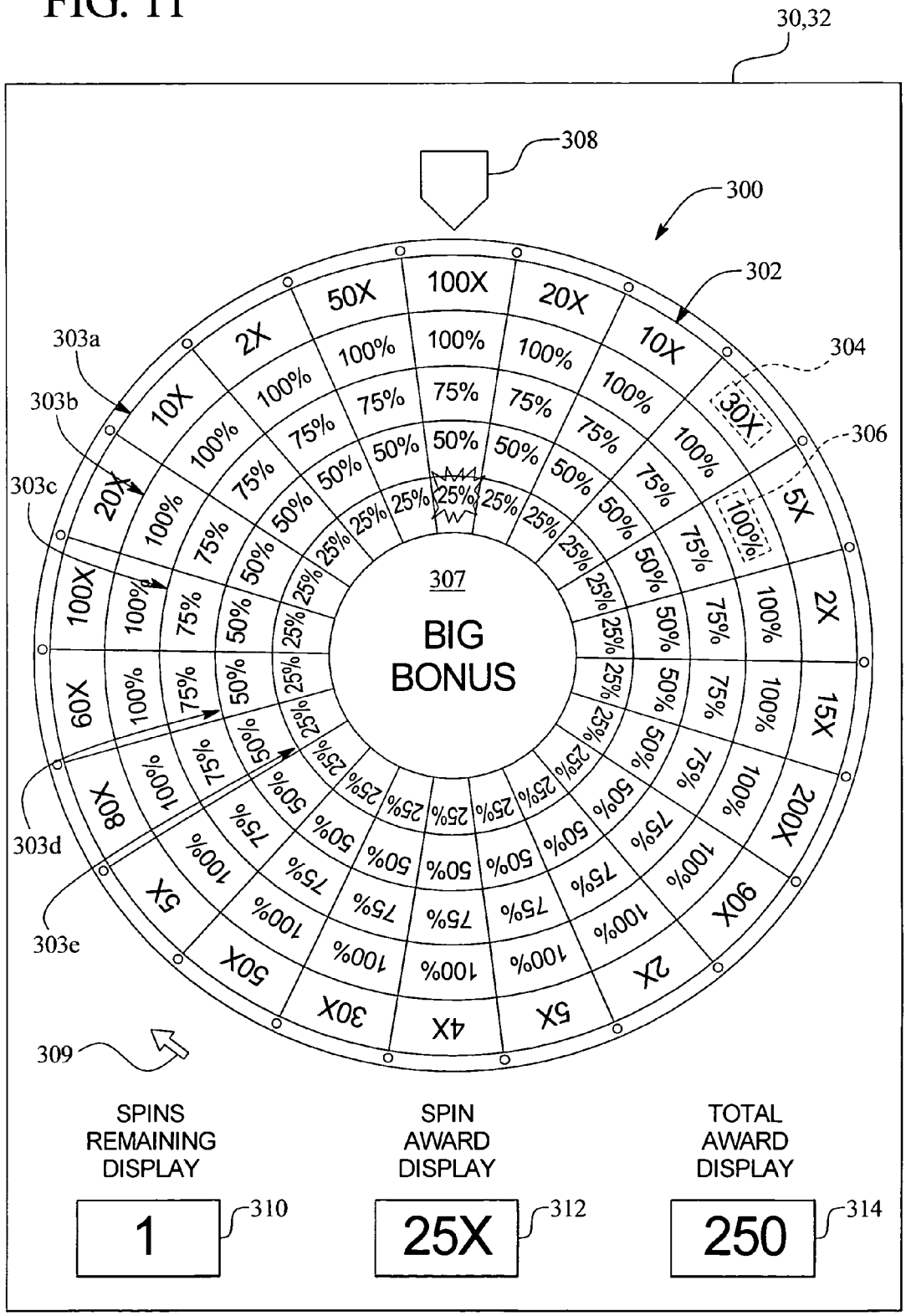
FIG. 11 is an enlarged elevation view of another alternative embodiment of the present invention where the sections includes multipliers and percentages of those multipliers.

Referring to FIG. 11, another alternative embodiment of the present invention is illustrated where the modifier group or annular area 303*a* of the award wheel 300 includes sections 302 having different multipliers. Also, modifier groups 303*b*, 303*c*, 303*d* and 303*e* include sections having award percentages 306. In this embodiment, the gaming device alternatively illuminates the modifier groups or annular areas 303 until picking one of the groups. The gaming device then spins the award wheel in a clockwise direction as shown by arrow 309. The section indicated by the section indicator 308 in the indicated modifier group is associated with one of the multipliers 304 in that group. The gaming device then multiplies the multiplier 304 associated with the indicated section in the highlighted modifier group to provide the player with a multiplier for that spin.

For example, a section in the modifier group 303*e* including an award percentage of 25% is indicated by the section indicator 308 as shown in FIG. 11. The indicated section is associated with a multiplier of one hundred, which is also indicated by the section indicator 308. The multiplier provided to the player for that spin therefore is 25% of the multiplier one hundred, which is a multiplier of 25 or 25×. The multiplier, 25×, is then indicated by the spin award display 312. In one embodiment, an award provided to the player in a primary or base game is multiplied by the multiplier indicated by that spin (i.e., 25×). In another embodiment, the gaming device provides a predetermined award in the game such as in a secondary or bonus game, and that award is multiplied by the indicated multiplier in that spin. In this example, the gaming device randomly provided the player with an award of ten for that spin and therefore the award of ten is multiplied by the spin award of 25× to provide the player with a total award of two hundred fifty as indicated by the total award display 314. It should be appreciated that the gaming device may accumulate the multipliers obtained in the spins in the game and use the total multiplier to multiply a previous award or a subsequent award in the game. It should also be appreciated that the multipliers indicated in the symbol groups or annular areas 303*a* may be any suitable multipliers desired by the game implementor. The player has one spin remaining as indicated by the spins remaining display 310.

Figure 12:
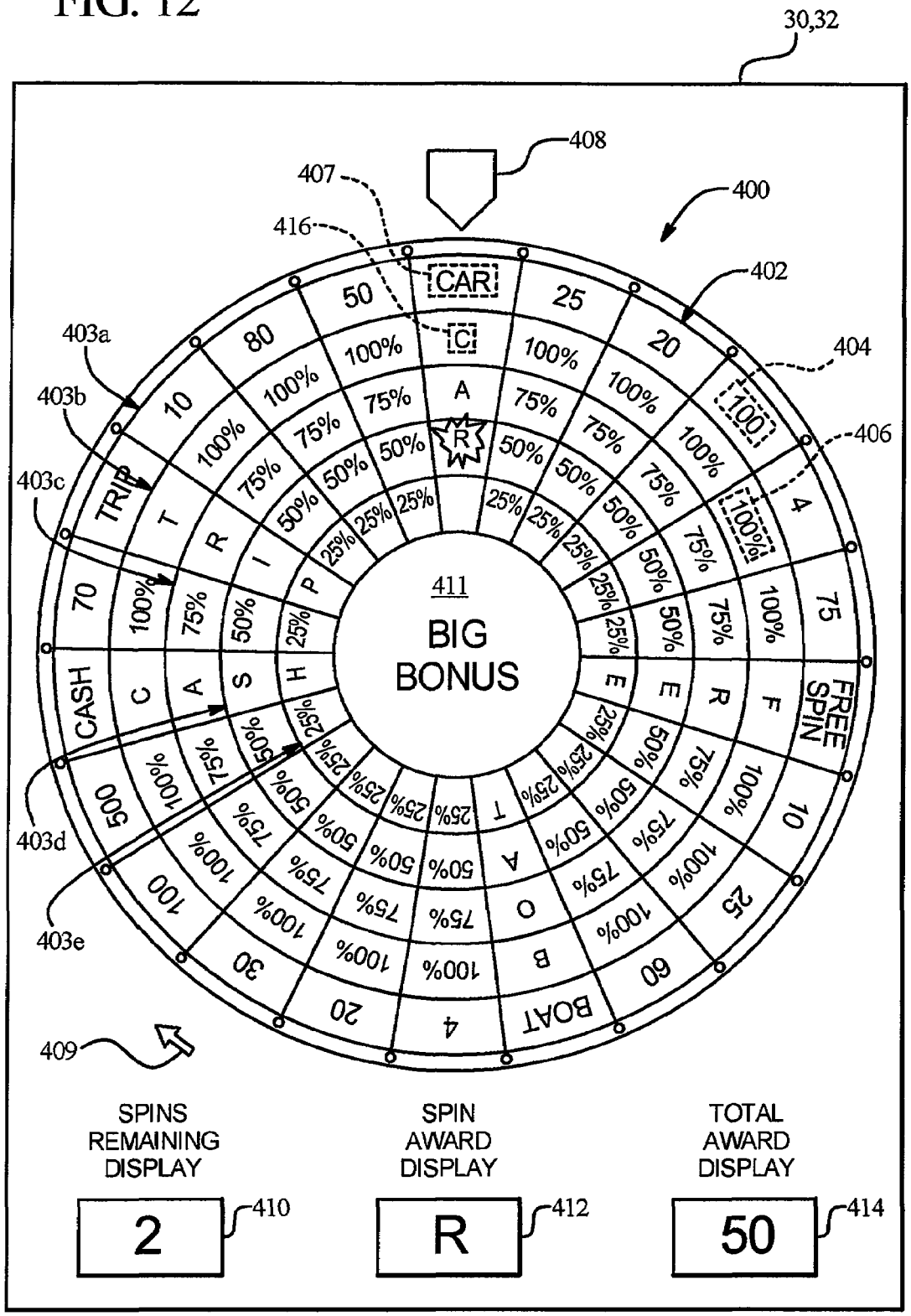
FIG. 12 is an enlarged elevation view of a further alternative embodiment of the present invention where the sections include awards, percentages of those awards, and letters which form a prize or prizes.

Referring to FIG. 12, a further alternative embodiment of the present invention is illustrated where the award wheel 400 includes a plurality of groups or annular areas 403*a*, 403*b*, 403*c*, 403*d*, and 403*e* including sections 402. In this embodiment, the group or annular area 403*a* includes sections having a plurality of awards 404 and prizes 409. The awards may be any suitable type of awards and the prizes 409 may include any suitable prizes such as a car, a free spin or spins, a boat, cash, or a trip. As described above, a gaming device alternatively illuminates the annular areas 403 to indicate one of the areas in that spin. The gaming device then spins the award wheel 400 in a clockwise direction as shown by arrow 409, until the section indicator 408 indicates one of the sections in the indicated annular area 403*a*. If a section including an award percentage 406 is indicated, the gaming device provides the player with the award associated with the indicated section of the annular area 403*a*. The multiplied award is then indicated in the spin award display 412. The total award display 414 indicates 50. The player has two spins remaining in the game, as indicated by the spins remaining display 410.

Each prize 409 includes sections that have letters 416 which spell out a word or words associated with the prize. If the player indicates all of the sections (i.e., accumulates all the letters or sections associates with that prize), the gaming device provides the prize to the player in the game. For example, if the player spins the wheel in the game and indicates all of the letters including the blank space associated with the car, the gaming device provides the car to the player. Additionally, if the player indicates all of the sections including all of the award percentages associated with the award, the gaming device provides the player with the big bonus award 411. It should be appreciated that the big bonus award 411 may be provided to the player when the player indicates all the sections associated with one of the awards or one of the prizes. The addition of the prizes to the game increases the excitement and enjoyment of the game for the player. If the player wins one of the prizes, the gaming device indicates the prize in the spin award display 412. A receipt or suitable redemption coupon is printed by the gaming device and the player redeems the prize at a remote location or other suitable redemption location.

Figure 13:
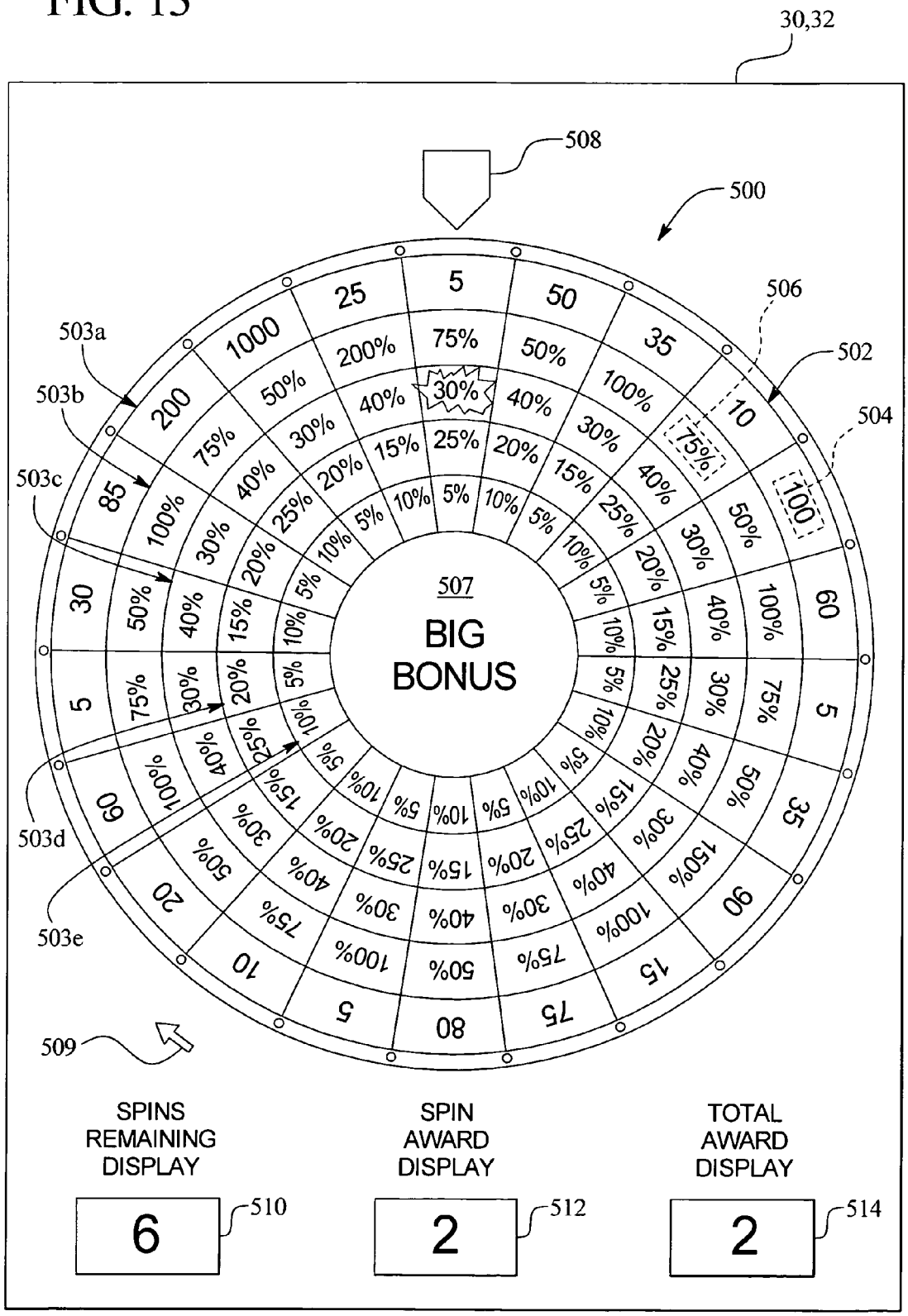
FIG. 13 is an enlarged elevation view of another alternative embodiment of the present invention where the sections of the wheel include awards and different award percentages.

Referring to FIG. 13, another alternative embodiment of the present invention is illustrated where the award wheel 500 includes groups or annular areas 503*a*, 503*b*, 503*c*, 503*d* and 503*e*. In this embodiment, the groups include sections 502 having awards and award percentages. The awards 504 may be any suitable type of awards desired by the game implementor. Each of the annular areas 503 include separate wheels such that each of the wheels independently rotates with respect to the other wheels. Additionally, each of the sections 502 associated with the groups 503*b*, 503*c*, 503*d* and 503*e* include a plurality of different award percentages. For example, the award percentages associated with group 503*b* are different than the award percentages associated with groups 503*c*, 503*d* and 503*e*. In a game therefore, the gaming device alternatively illuminates the groups or wheels 503 to indicate one of the groups or wheels in that spin. The gaming device then spins one or more of the wheels including the groups in a clockwise direction as shown by arrow 509 until the section indicator 508 indicates one of the sections in the highlighted or indicated group. The indicated section includes an award percentage 506. The section indicator 508 also indicates a section in the symbol group 503*a* having an award 504. The indicated award 504 is multiplied by the indicated award percentage 506 to provide a spin award or multiplied award of 2 as indicated by the spin award display 512 to the player in that spin. The total award display 514 indicates 2. The player has six spins remaining in the game, as indicated by the spins remaining display 510. The player then spins the wheel or wheels until there are no spins remaining in the game.

The different award percentages provide an extra level of excitement and enjoyment to a player in a game because the player's award depends on two factors. One factor is the award indicated by the section indicator 508 in a spin and the second factor is the award percentage indicated in that spin. Also, because the award wheels all independently rotate, it is more difficult to accumulate all of the sections associated with the particular award because one or more of the wheels including the sections are moving in each spin.

In another embodiment, the gaming device enables a player to pick or select an annular area or pie-shaped area or segment of the wheel prior to playing the game or initiating the spins of wheel in the game. It should be appreciated that the gaming device may enable the player to pick one, a plurality or the annular areas and/or pie-shaped segments or areas of the wheel in a game. It should also be appreciated that the gaming device may enable the player to pick the annular area or areas or pie-shaped section or sections prior to playing the game, prior to one spin in the game or prior to a plurality of the spins in the game. For example, a player picks one of the annular areas on the wheel and then spins the wheel. The section indicator indicates one of the sections in the annular area picked by the player and provides the award associated with that section. It should be appreciated that the gaming device may enable the player to pick one of the annular areas or pie-shaped sections by pressing or touching the corresponding annular area or section on a touch screen display device or by pressing a button or similar input device which corresponds to the annular area or pie-shaped section on the wheel.

In a further embodiment, the gaming device of the present invention is employed in a progressive type game where a player accumulates indicated sections on the wheel in the plurality of games. In this embodiment, the indicated sections remain highlighted or illuminated for a designated number of games. The designated number of games may be predetermined, randomly determined or determined in any suitable manner. The progressive accumulation of the indicated sections enables one or more players to be able to accumulate multiple sections in a game or games and also increases the probability that a player will obtain the big bonus award by accumulating all the sections associated with one of the awards in the outer most annular area in a game. In one aspect of this embodiment, the awards are associated with a probability of being indicated such that the relatively small awards include greater probabilities than the relatively large awards. In this aspect, a significant portion of the relatively small awards are indicated before the relatively large awards are indicated on the wheel. This creates excitement and enjoyment of the game because the longer the game is played or the more games that are played, more of the sections of the wheel are illuminated or indicated. Also, as more sections are indicated on the wheel, the awards associated with the non-indicated sections increase to enable players to obtain larger awards in a game or games. Once the designated number of games are reached, the gaming device resets the award wheel so that none of the sections are indicated (i.e., highlighted) on the wheel. It should be appreciated that the gaming device may reset the award wheel so that none, one, a plurality or all of the sections remain highlighted on the wheel.

In another embodiment, a plurality of section indicators are associated with the wheel such that multiple sections are indicated on the wheel in a spin. This enables a player to obtain multiple awards associated with the multiple sections indicated on the wheel in a single spin. In one embodiment, the section indicators associated with the wheel are activated such that only the activated section indicators indicate sections on the wheel. The section indicators may be activated by particular sections on the wheel or based on the number of spins provided to the player in the game. The number of section indicators may also be based on a wager made by the player in the base game or in a bonus game.

In a further embodiment the multiple section indicators are moveable such that the section indicators move about the wheel at the beginning of a game and are stopped or locked in place by the gaming device or the player. The section indicators may move at the beginning of the game, during the game, after one spin or a plurality of the spins of the wheel or at any suitable point in a game. The moveable indicators enable the player to interact with the game and therefore provides additional excitement and enjoyment of the game.

In another embodiment, a time dimension is associated with the present invention to offer enhanced play and awards in the game. In one aspect of this embodiment, a larger award or awards are provided to the player when a designated number of sections are indicated in a designated number of spins of the wheel. For example, the gaming device provides a larger award or a bonus award to a player when the player indicates all of the sections associated with one of the awards in a particular number of spins such as five spins. The gaming device decreases the award for each additional spin or spins needed by the player to indicate those sections.

In another aspect of this embodiment, the gaming device only provides a bonus award when the player indicates a specific section or sections in a designated number of spins. If the section or sections are indicated after the designated number of spins are reached, the gaming device does not provide a bonus or extra award to the player. It should be appreciated that the designated section or sections may be predetermined, randomly determined or determined according to any suitable determination method.

In a further aspect of this embodiment, a time period is associated with the game such that the gaming device or the player spins the wheel during the time period and indicates sections and accumulates awards associated with those sections during the time period. When the time period expires, the game ends and the player receives the total accumulative award for the game.

It should be appreciated that the present invention may be employed in a primary or base game or, a secondary or bonus game or any suitable type of game such as poker, blackjack, roulette, dice, slots, multi-line slots or any other suitable wagering game.

It should also be appreciated that multiple pointers or indicators for simultaneously indicating different sections may be employed in the present invention.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a game operable upon a wager;

an award distributor including a plurality of sections, each of said sections defined by one of a plurality of first coordinates and one of a plurality of second coordinates;

a plurality of groups of said sections including a symbol group and a plurality of modifier groups, wherein the first coordinate and the second coordinate of at least one section of a designated one of the groups is different from the first coordinate and second coordinate of at least one of the other sections in said designated group;

a plurality of symbols associated with the sections in the symbol group;

a plurality of modifiers associated with the sections in the modifier groups;

at least one section indicator associated with the award distributor; and a processor operable to determine one of the first coordinates, independently determine one of the second coordinates, cause the section indicator to indicate the section in the modifier group associated with the determined first and second coordinates, cause the section indicator to indicate one of the sections in the symbol group and provide an activation award to a player based on the symbol and the modifier associated with the indicated sections.

2. The gaming device of claim 1, which includes a probability of being determined associated with each of the first and second coordinates.

3. The gaming device of claim 2, wherein a plurality of the probabilities are the same.

4. The gaming device of claim 2, wherein all of the probabilities are the same.

5. The gaming device of claim 1, which includes a probability of being indicated by the section indicator associated with each of the sections, wherein the processor determines the first and second coordinates based on said probabilities.

6. The gaming device of claim 1, wherein the symbols are award symbols.

7. The gaming device of claim 6, which includes a plurality of awards associated with the award symbols.

8. The gaming device of claim 6, which includes a plurality of awards associated with the award symbols and a plurality of award percentages associated with the modifiers, wherein the activation award equals the award associated with the indicated section in the symbol group multiplied by the award percentage associated with the indicated modifier group.

9. The gaming device of claim 7, wherein the awards include at least one of the awards selected from the group consisting of: a value, a modifier, a multiplier, a free activation, a free spin, a free game and a prize.

10. The gaming device of claim 7, wherein the awards include at least one large award which has a greater value than a plurality of small awards.

11. The gaming device of claim 10, which includes a probability of being selected by the processor associated with the awards, wherein the probability associated with the large award is less than the probability associated with at least one of the small awards.

12. The gaming device of claim 10, which includes a probability of being selected by the processor associated with the awards, wherein the probability associated with the large award is less than the probabilities associated with a plurality of the small awards.

13. The gaming device of claim 10, which includes a probability of being selected by the processor associated with the awards, wherein the probability associated with the large award is less than the probabilities associated with all of the small awards.

14. The gaming device of claim 1, wherein the modifiers include a plurality of award percentages.

15. The gaming device of claim 14, wherein the sections in the modifier groups include a plurality of low award percentages which are lower than a plurality of high award percentages.

16. The gaming device of claim 14, wherein each of the sections in a group of said modifier groups include the same award percentages.

17. The gaming device of claim 14, wherein at least one of the modifier groups includes different award percentages.

18. The gaming device of claim 14, wherein a plurality of the modifier groups include different award percentages.

19. The gaming device of claim 14, wherein all of the modifier groups include different award percentages.

20. The gaming device of claim 19, wherein the modifier groups include higher award percentages in each successive modifier group.

21. The gaming device of claim 19, wherein the sections in the modifier groups include lower award percentages in each successive modifier group.

22. The gaming device of claim 1, which includes a plurality of potential total awards, whereby said processor picks one of the symbols and one of the modifiers and repeatedly causes the section indicator to indicate sections on the award distributor until the activation awards based on the symbols and the modifiers on the indicated sections equal the total award.

23. The gaming device of claim 22, wherein the total awards are associated with probabilities of being picked by the processor.

24. The gaming device of claim 1, wherein the section indicator includes at least one illumination device operable to illuminates the sections in the modifier groups on the award distributor.

25. The gaming device of claim 1, wherein the section indicator includes at least one illumination device associated with each of the sections in the modifier groups, wherein the illumination device is operable to illuminate one of the sections in said groups of sections on the award distributor.

26. The gaming device of claim 1, wherein the section indicator includes a plurality of illumination devices which are operable to simultaneously illuminate a plurality of the sections in the modifier groups on the award distributor.

27. The gaming device of claim 1, wherein the section indicator includes a plurality of illumination devices which are operable to alternately illuminate a plurality of the sections in the modifier groups on the award distributor.

28. The gaming device of claim 1, wherein the section indicator includes at least one illumination device which is operable to illuminate the sections in the symbol group on the award distributor.

29. The gaming device of claim 1, wherein a plurality of the sections in the modifier groups include a terminator symbol.

30. The gaming device of claim 29, which includes a probability of being indicated by the section indicator associated with each of the sections in the modifier groups, wherein the probabilities associated with the sections including the terminator symbols are greater than the probabilities associated with a plurality of the other sections in the modifier groups.

31. The gaming device of claim 29, which includes a probability of being indicated by the section indicator associated with each of the sections in the modifier groups, wherein the probabilities associated with the sections including the terminator symbols are greater than the probabilities associated with all of the other sections in the modifier groups.

32. The gaming device of claim 1, wherein a plurality of the sections in the symbol group include a terminator symbol.

33. The gaming device of claim 1, wherein the award distributor includes an award wheel.

34. The gaming device of claim 33, which includes a spin initiator controlled by the processor for enabling the player to cause the processor to initiate each movement of one of said wheel and said section indicator.

35. The gaming device of claim 1, wherein the award distributor includes a plurality of wheels.

36. The gaming device of claim 35, wherein the symbol group and plurality of modifier groups are on different wheels.

37. The gaming device of claim 35, wherein the symbol group and each of the modifier groups are on different wheels.

38. The gaming device of claim 1, which includes a bonus award provided to the player when at least one section in each of the modifier groups is indicated by the section indicator.

39. The gaming device of claim 1, wherein the modifiers include award percentages, and wherein at least two of the award percentages in each of the modifier groups are different.

40. The gaming device of claim 1, which includes a selector, which enables a player to pick one of the sections, a plurality of the sections or all of the sections on the award distributor.

41. The gaming device of claim 1, wherein the section or sections indicated by the section indicator in at least one spin remain indicated for a designated number of spins.

42. The gaming device of claim 41, wherein the designated number of spins is randomly determined.

43. The gaming device of claim 41, wherein the designated number of spins is pre-determined.

44. The gaming device of claim 41, wherein the designated number of spins is determined based on a wager made by the player.

45. The gaming device of claim 1, which includes a plurality of section indicators associated with the award distributor.

46. The gaming device of claim 45, which includes a plurality of activatable section indicators associated with the award distributor, wherein only the activated section indicators indicate sections on the award distributor.

47. The gaming device of claim 46, wherein the section indicators are randomly activated.

48. The gaming device of claim 46, wherein the section indicators are activated based on a wager made by a player.

49. The gaming device of claim 46, wherein the section indicators are activated based on a number of activations of the award distributor.

50. The gaming device of claim 1, which includes designated sections to be indicated in a designated number of activations of the award distributor.

51. The gaming device of claim 1, which includes designated sections to be indicated in a designated time period.

52. A gaming device comprising:

a plurality of award wheels, each of said award wheels including a plurality of sections, each of said sections having a first coordinate from a plurality of first coordinates and a second coordinate from a plurality of second coordinates;

a plurality of groups of said sections including a symbol group and a plurality of modifier groups, wherein the symbol group is included on one of the award wheels and the plurality of modifier groups are displayed by different award wheels;

a plurality of awards associated with the sections in the symbol group;

a plurality of award percentages associated with the sections in the modifier groups;

at least one section indicator associated with the award wheels; and a processor operable to determine one of the first coordinates, independently determine one of the second coordinates spin at least one of the wheels, cause the section indicator to indicate the section in the modifier group associated with the determined first and second coordinates, cause the section indicator to indicate one of the sections in the symbol group and provide an activation award to a player based on the award and the award percentage associated with the indicated sections.

53. The gaming device of claim 52, wherein the awards include at least one of the awards selected from the group consisting of: a value, a modifier, a multiplier, a free activation, a free spin, a free game and a prize.

54. The gaming device of claim 52, wherein the awards include at least one large award which has a greater value than a plurality of small awards.

55. The gaming device of claim 54, which includes a probability of being selected by the processor associated with the awards, wherein the probability associated with the large award is less than the probability associated with at least one of the small awards.

56. The gaming device of claim 54, which includes a probability of being selected by the processor associated with the awards, wherein the probability associated with the large award is less than the probabilities associated with a plurality of the small awards.

57. The gaming device of claim 54, which includes a probability of being selected by the processor associated with the awards, wherein the probability associated with the large award is less than the probabilities associated with all of the small awards.

58. The gaming device of claim 52, wherein the sections in the modifier groups include a plurality of low award percentages which are lower than a plurality of high award percentages.

59. The gaming device of claim 52, wherein each of the sections in a group of said modifier groups include the same award percentages.

60. The gaming device of claim 40, wherein at least one of the modifier groups includes different award percentages.

61. The gaming device of claim 52, wherein a plurality of the modifier groups include different award percentages.

62. The gaming device of claim 52, wherein all of the modifier groups include different award percentages.

63. The gaming device of claim 52, wherein the modifier groups include higher award percentages in each successive modifier group on the wheels.

64. The gaming device of claim 52, wherein the modifier groups include lower award percentages in each successive modifier group.

65. The gaming device of claim 52, wherein the symbol group and each of the modifier groups are on different wheels.

66. The gaming device of claim 52, which includes a bonus award provided to the player when at least one section in each of the modifier groups is indicated by the section indicator.

67. A gaming device comprising:

an award distributor including a plurality of sections, each of said sections having one of a plurality of first coordinates and one of a plurality of second coordinates;

a plurality of groups of said sections including an award group and a plurality of symbol groups;

a plurality of awards associated with the sections in the award group, said award including at least one prize;

a plurality of symbols associated with the sections in the symbol groups, said symbols including a plurality of award percentages and at least one letter associated with the prize;

at least one section indicator associated with the award distributor; and a processor operable to determine one of the first coordinates, independently determine one of the second coordinates, cause the section indicator to indicate the section in the symbol group associated with the determined first and second coordinates, cause the section indicator to indicate one of the sections in the award group and provide an activation award to the player based on the award and the symbol associated with the indicated sections.

68. The gaming device of claim 67, wherein the prize is provided to the player when all of the letters associated with the prize are indicated by the section indicator.

69. The gaming device of claim 67, wherein the prize is at least one of the prizes selected from the group consisting of: a physical prize, a monetary prize, a free spin, a free game, a multiplier and a trip.

70. The gaming device of claim 67, wherein said symbols include a plurality of letters associated with a prize, wherein each letter is included in a different symbol group.

71. The gaming device of claim 70, wherein the prize is provided to the player when the letters in each of the symbol groups associated with the prize are indicated by the section indicator.

* * * * *